US006748845B2

(12) United States Patent
Staiert et al.

(10) Patent No.: US 6,748,845 B2
(45) Date of Patent: Jun. 15, 2004

(54) ORGANIC CARGO HANDLING SYSTEM

(75) Inventors: Richard W. Staiert, Coon Rapids, MN (US); Robert B. Stratton, Andover, MN (US)

(73) Assignee: United Defense, L.P., Arlington, VA (US)

( * ) Notice: Subject to any disclaimer, the term of this patent is extended or adjusted under 35 U.S.C. 154(b) by 0 days.

(21) Appl. No.: 10/113,795

(22) Filed: Mar. 29, 2002

(65) Prior Publication Data

US 2002/0148348 A1 Oct. 17, 2002

Related U.S. Application Data

(63) Continuation-in-part of application No. 09/834,821, filed on Apr. 13, 2001.
(60) Provisional application No. 60/243,709, filed on Oct. 27, 2000.

(51) Int. Cl.[7] ..... F41A 23/26
(52) U.S. Cl. ..... 89/40.13; 89/40.07; 89/40.08; 89/40.12
(58) Field of Search ..... 89/37.01, 37.13, 89/40.01, 40.07, 40.08, 40.13, 40.14, 40.12

(56) References Cited

U.S. PATENT DOCUMENTS

| | | | | |
|---|---|---|---|---|
| 911,810 | A | 2/1909 | Dreger | |
| 2,339,334 | A | 1/1944 | Heaslet | |
| 2,549,835 | A | 4/1951 | McCann et al. | |
| 3,366,009 | A | 1/1968 | Aldrin | |
| 4,729,279 | A | 3/1988 | Collanus et al. | 89/40.13 |
| 5,461,961 | A | 10/1995 | Baus et al. | |
| 6,024,007 | A | 2/2000 | Searle et al. | 89/43.01 |
| 6,178,866 | B1 | 1/2001 | Searle et al. | 89/37.08 |
| 6,290,449 | B1 * | 9/2001 | Lewis | 414/563 |

FOREIGN PATENT DOCUMENTS

| | | |
|---|---|---|
| EP | 0179753 | 4/1986 |
| FR | 2663727 | 12/1991 |
| GB | 2 317 380 A * | 3/1998 |

OTHER PUBLICATIONS

Military Analysis Network, C–130 Hercules—Military Aircraft. Internet pages, 15 pages, no date.
Military Analysis Network, M1086 LWB Truck. Internet pages. 5 pages, no date.
Military Analysis Network, XM777 Lightweight 155 mm howitzer (LW155). Internet pages, 8 pages, no date.
Lightweight 155mm (LW155) System Performance Specification. 55 pages, no date.

* cited by examiner

*Primary Examiner*—Stephen M. Johnson
(74) *Attorney, Agent, or Firm*—Patterson, Thuente, Skaar & Christensen, P.A.

(57) ABSTRACT

An organic cargo handling system, includes a tactical vehicle, a bed disposable on the vehicle, the bed including a tiltable bed portion, the tiltable bed portion including a quick hitch, the tiltable bed portion quick hitch is translatably disposed on a track, the track being operably coupled to the tiltable bed portion, quick hitch being powerable in a first direction along the track and being powerable in a second opposed direction along the track, and a cargo handling apparatus being couplable to the quick hitch for selective engagement with an article to be transported on the tactile vehicle to advance said article up the tiltable bed portion for loading thereon and to urge the article down the tiltable bed portion for offloading thereof. A vehicle bed and a method of deploying material in a field are further included.

42 Claims, 25 Drawing Sheets

10
76
12
80
60
60
52
58b
58a
56b
56a
54
54
14
40
44
42

10
114
116
60
80
58a
12
14
54
56a
40
44
42

THE WEBSITE FOR DEFENCE INDUSTRIES - ARMY click here Return to main profile

ESG

Artillery Computer Network click here Return to main profile

ESG

Cargo in ready to load position

Cargo in loaded position

ORGANIC CARGO HANDLING SYSTEM

RELATED APPLICATION

The present application is a Continuation-in-Part of U.S. application Ser. No. 09/834,821 filed Apr. 13, 2001, which claims the benefit of U.S. Provisional Application No. 60/243,709 filed Oct. 27, 2000 now abandoned.

TECHNICAL FIELD

The present invention relates to military cargo handling. More particularly, the present invention relates to a transport vehicle, the transport vehicle being deployable with a relatively small military unit and having versatile cargo handling capabilities to support the military unit.

BACKGROUND OF THE INVENTION

There is a need for highly mobile combat units. The units should include a fleet of vehicles where each of the individual combat vehicles, the crews to man such vehicles, and sufficient fuel and ammunition should be transportable on a single transport aircraft. Specifically, the aircraft to provide the transportation is the C-130 type aircraft. Further, there is a need for the containerization/palletizing of some mission equipment that is currently mounted on trailers or is permanently mounted on a dedicated truck chassis, such as radars, generator sets, command centers, communications sets, and maintenance vans. Such containerization/palletizing would reduce the number of vehicles need to be deployed with a given military unit, making the transport requirements for getting the unit in the field and ready to operate much simpler, more quickly and less costly.

Further, there is a need is for providing enhanced organic cargo handling capability to military units. This includes the ability to load and unload palletized and other outsized cargo directly. Presently a military unit desiring to load and unload palletized and other outsized cargo would normally require the use of a forklift or other material handling equipment to effect such loading and unloading.

Additionally, there is a need for a recovery vehicle capable of allowing the unit to recover a disabled vehicle such as a High Mobility Multipurpose Wheeled Vehicle (HMMWV) (commonly referred to as a "Humvee") without the use of a specialized recovery vehicle (wrecker) and/or without having to tow bars/cables to tow a disabled vehicle. Frequently, such specialized recovery vehicles are in short supply and are typically deployed a relative great distance from the site of the disabled vehicle, thereby greatly hampering the recovery of the disabled vehicle. There is further a need to maximize the currently existing equipment content of such a system in order to maintain low cost and to provide a low technical and schedule risk approach that will quickly provide enhanced organic cargo handling capability.

SUMMARY OF THE INVENTION

The enhanced organic cargo handling capability system of the present invention substantially meets the aforementioned needs. In a preferred embodiment, the system may utilize an existing vehicle, such as the FMTV M1086A1 long wheelbase chassis truck that is currently in production. By using an existing vehicle, overall cost of the system is greatly reduced, the technical risk of the system is minimized and a schedule for making the system available to users is also greatly minimized. In order to form the improved system of the present invention, the vehicle undergoes certain modifications as noted below.

The major modification to the vehicle is the installation of the tilt bed, forming the rear portion of the vehicle bed. A stationary bed is preferably disposed forward of the tilt bed. The modified vehicle is used to pick up, transport and readily discharge a wide variety of cargo for enhanced tactical mobility.

This improvement to the present invention is an organic cargo handling system, including a tactical vehicle, a bed disposable on the vehicle, the bed including a tiltable bed portion, the tiltable bed portion including a quick hitch. The tiltable bed portion quick hitch is translatably disposed on a track, the track being operably coupled to the tiltable bed portion, quick hitch being powerable in a first direction along the track and being powerable in a second opposed direction along the track. A cargo handling apparatus is couplable to the quick hitch for selective engagement with an article to be transported on the tactical vehicle to advance said article up the tiltable bed portion for loading thereon and to urge the article down the tiltable bed portion for offloading thereof. The present invention is further a vehicle bed and a method of deploying material in the field.

DETAILED DESCRIPTION OF THE DRAWINGS

Figure 1:
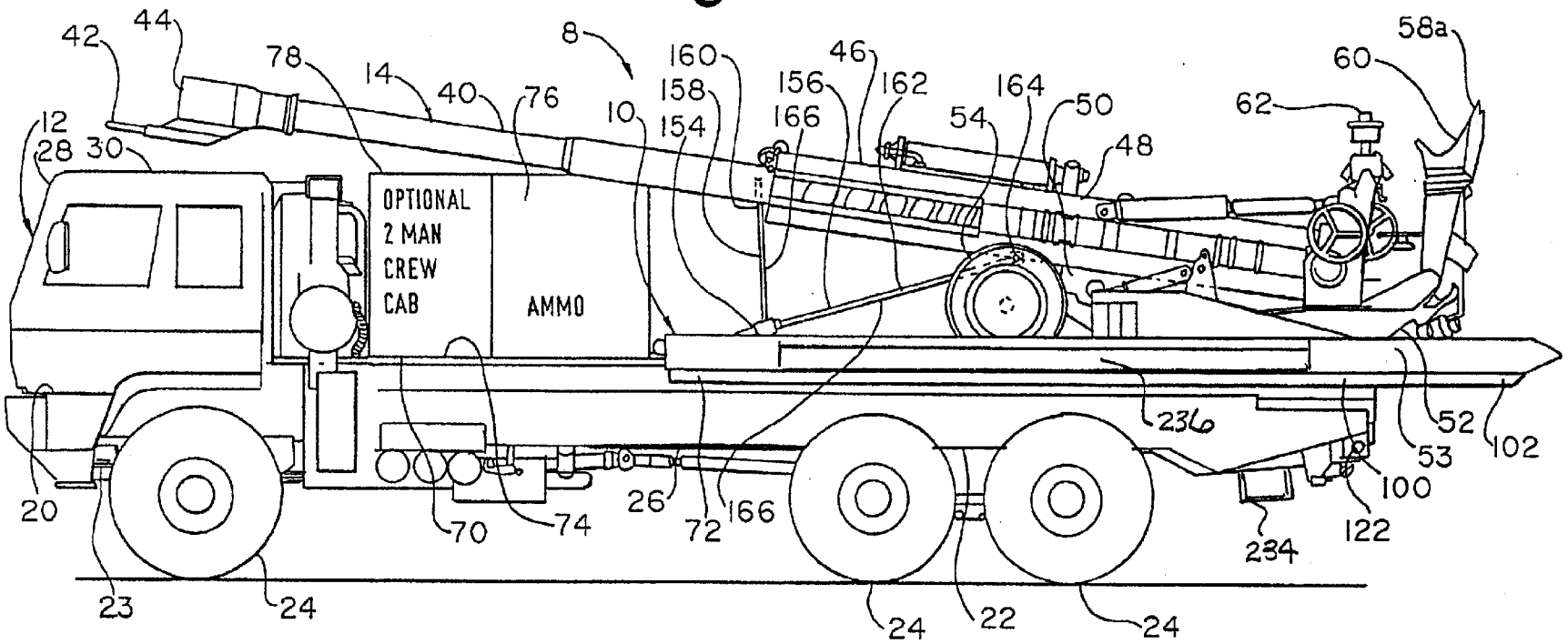
FIG. 1 is a side elevational view of the cannon system of the present invention in its original configuration with the howitzer mounted in the transport at disposition on the vehicle and the vehicle having the optional two man crew cab.

The high-mobility artillery cannon system of the present invention is shown generally at 8 in the figures. The cannon system 8 generally includes a tilt bed system 10 mounted on a vehicle 12, a howitzer 14 being loadable and unloadable from the vehicle 12 by means of the tilt bed system 10. In a first embodiment, without the enhanced organic cargo handling system, as depicted in FIGS. 1–6*h*, 8*a* and 8*b*, the preferred vehicle 12 that is a component of the cannon system 8 is designated a M1086A1 5.0 ton LWB (long wheelbase) vehicle. This vehicle 12 is one of the "Family of Medium Tactical Vehicles" (FMTV) that is currently being provided to U.S. and allied armed forces. The baseline vehicle 12 has a cargo handling crane disposed proximate the rear margin thereof. For use as a component of the cannon system 8 of the present invention, the cargo handling crane is removed from the vehicle 12. As currently being procured, the vehicle 12 is manufactured by Stewart & Stevenson of Sealy, Tex. Alternative embodiments of the tilt-bed concept could utilize other vehicles used to haul troops or cargo.

Detailed specifications of the above noted vehicle 12 are well known to those skilled in the art. Generally, the vehicle 12 has a chassis 20 that includes a rear wheel suspension 22 and a front wheel suspension 23 mounted to a frame 26. The wheel suspensions 22, 23 each support wheels 24. A cab-over type cab 28 is disposed at the forward end of the vehicle 12. The cab 28 is partially enclosed by the cab roof 30. A fishplate 32 is mounted proximate the rear margin of the frame 26. The fishplate 32 comprises a subframe that, in its normal configuration, supports the aforementioned cargo handling crane disposed at the rear of the vehicle 12. When the vehicle 12 is used as a component of the cannon system 8 of the present invention, the rearmost portion of the fishplate 32, which otherwise underlies and supports the crane, is removed.

The preferred howitzer 14 for use with the cannon system 8 is a light weight howitzer (LWH) designated XM777. The howitzer 14 is a 155 mm howitzer currently being supplied to the U.S. armed forces. The XM777 howitzer 14 is currently manufactured by BAE Systems, a firm located in the United Kingdom. Detailed specifications of the preferred howitzer 14 are well known to those skilled in the art.

Generally, the howitzer 14 includes an elevatable and tranversable tube 40. The tube 40 includes a tow eye 42 mounted proximate the muzzle 44 thereof. The tube 40 is coupled to a recoil mechanism 46 that is disposed proximate the breach 48 of the tube 40. The recoil mechanism 46 and the tube 40 are mounted on a cradle 50. The cradle 50 is elevatably coupled to an undercarriage 52. In addition to supporting the cradle 50, the undercarriage 52 has extendible wheels 54. The wheels 54 may be extended downward when the howitzer 14 is in a towing configuration and may be retracted up along side the cradle 50 when the howitzer 14 is deployed in a tactical mode.

The howitzer 14 is supported in the tactical disposition by a pair of foldable stabilizers 56*a, b*. The stabilizers 56*a, b* extend generally forward of the undercarriage 52 and are displaced relative to the tube 40 at an angle of about 20 degrees. In the transport mode, the foldable stabilizers 56*a, b* are folded rearward alongside the undercarriage 52 immediately rearward of the folded wheels 54.

The howitzer 14 is further supported in the tactical disposition by a pair of extendible trails 58*a*, 58*b*. Each of the extendible trails 58*a*, 58*b* has a large shovel 60 disposed at the distal end thereof. In the tactical disposition, the trails 58*a*, 58*b* are folded rearward and slightly outward from the undercarriage 52. The shovels 60 engage the soil and will dig into the soil responsive to recoil generated by firing the howitzer. In the transport mode, the extendible trails 58*a*, 58*b* are folded upward at the rear of the undercarriage 52, as depicted in FIGS. 1 and 3–6*h*.

Figure 7:
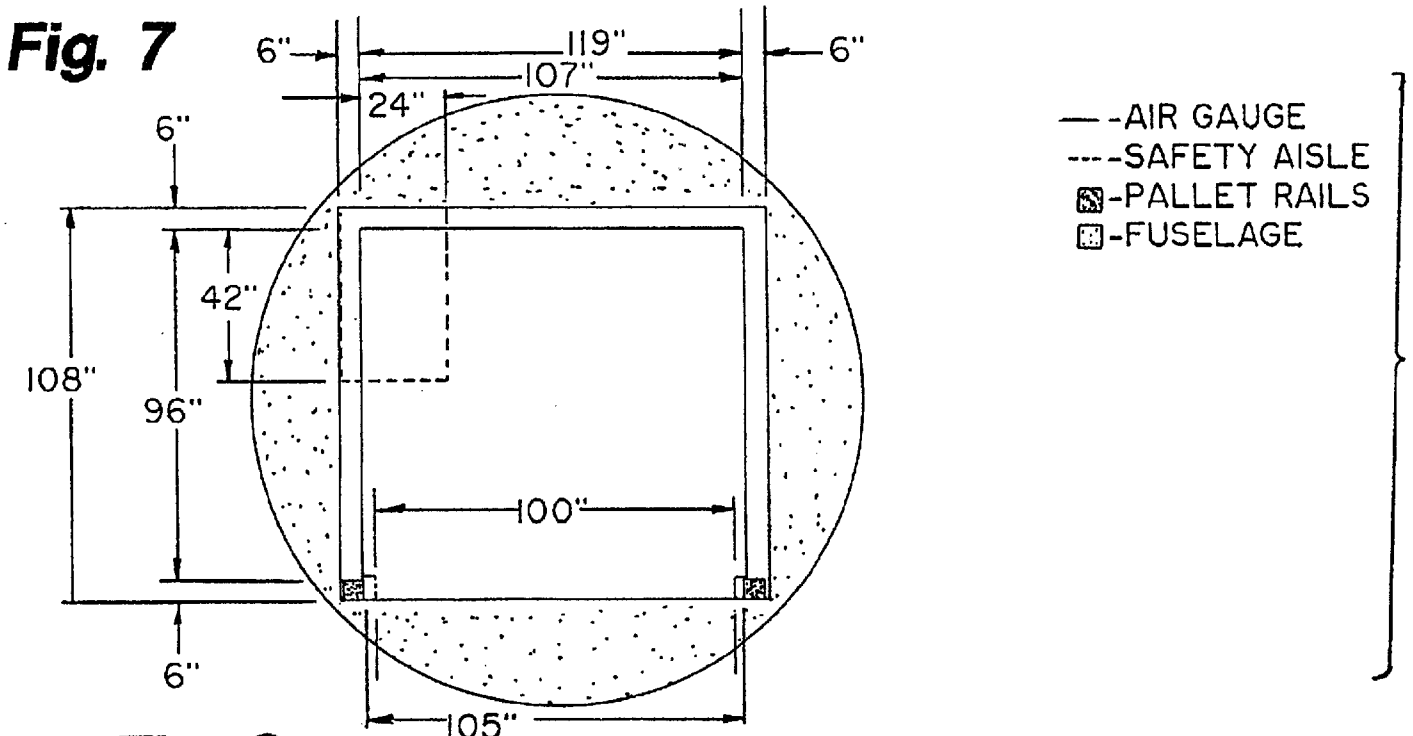
FIG. 7 is a cross sectional view of the cargo area of a C-130 type aircraft.

A pair of optical sight mounts 62 are disposed on the undercarriage 52 displaced slightly left and right of the centerline of the tube 40. Preferably, the sights themselves (not shown) are conveyed in a protected container and manually mounted on the optical sight mounts 62 prior to laying of the howitzer 14. As will be noted later, the upper margin of the optical sight mounts 62 present a challenge for the cannon system 8 in meeting the height limitations of the cargo envelope of the selected transport aircraft, the C-130 as depicted in FIG. 7.

Figure 2:
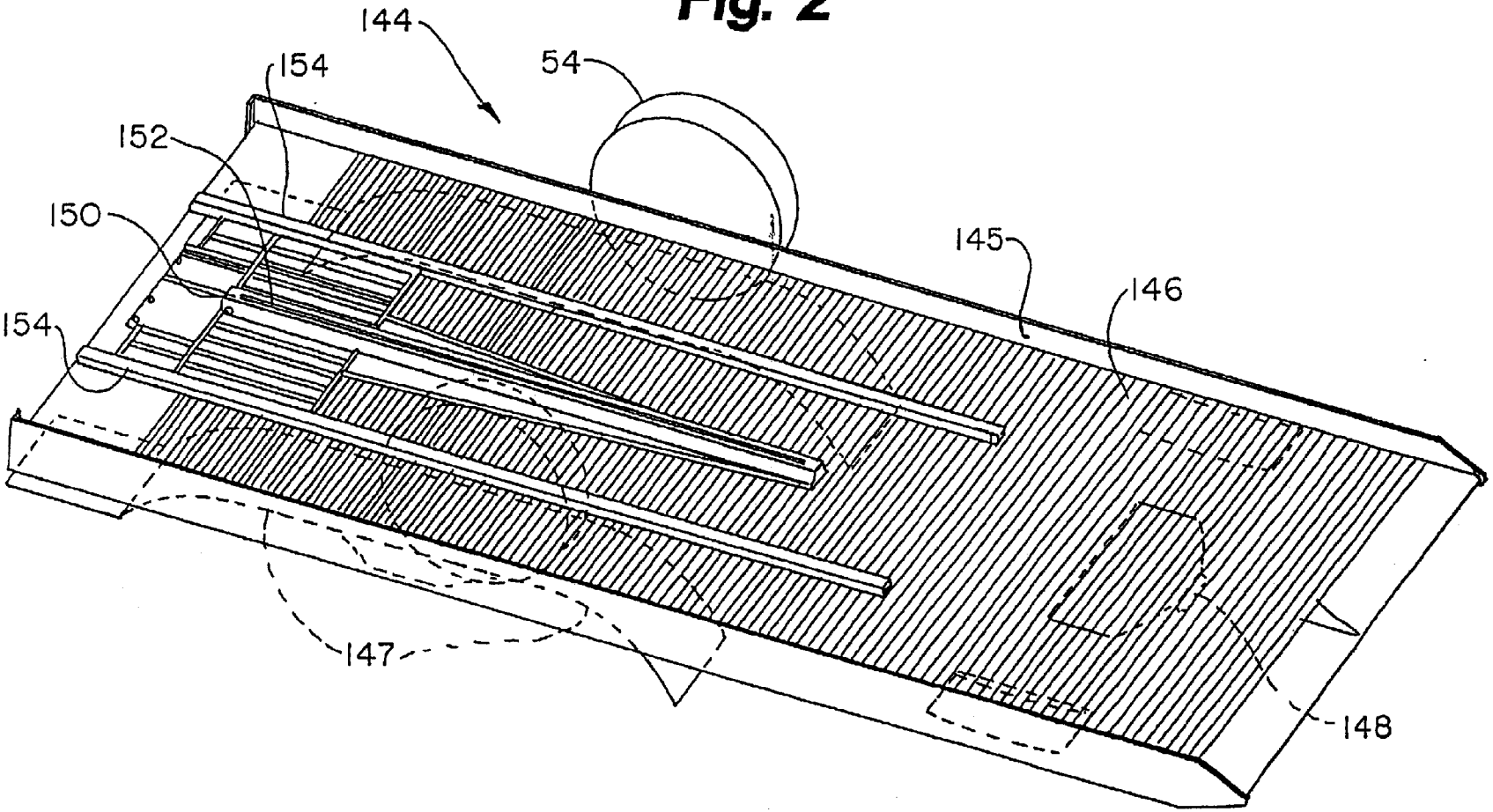
FIG. 2 is a perspective view of the tilt bed with the howitzer wheels depicted as wire drawings in the transport disposition.
Figure 3:
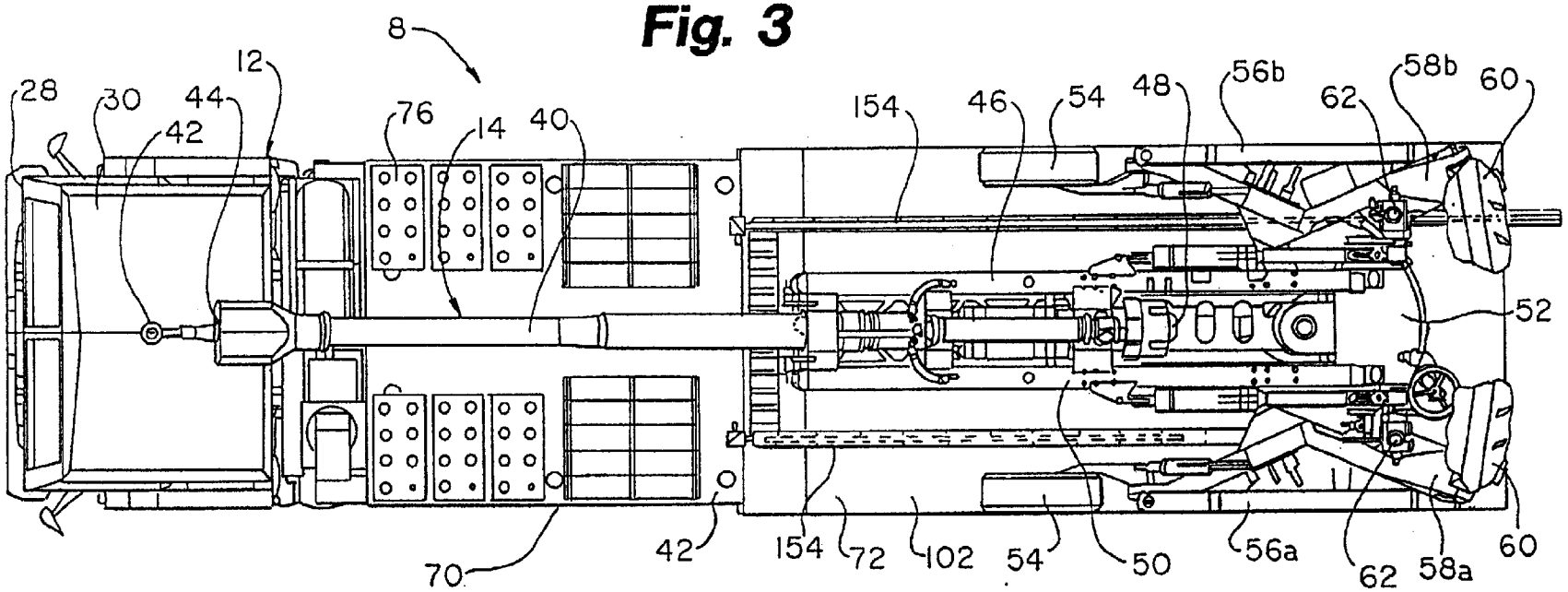
FIG. 3 is a top elevational view of the cannon system with an alternative ammunition storage arrangement on the vehicle and the howitzer in the transport disposition.
Figure 4:
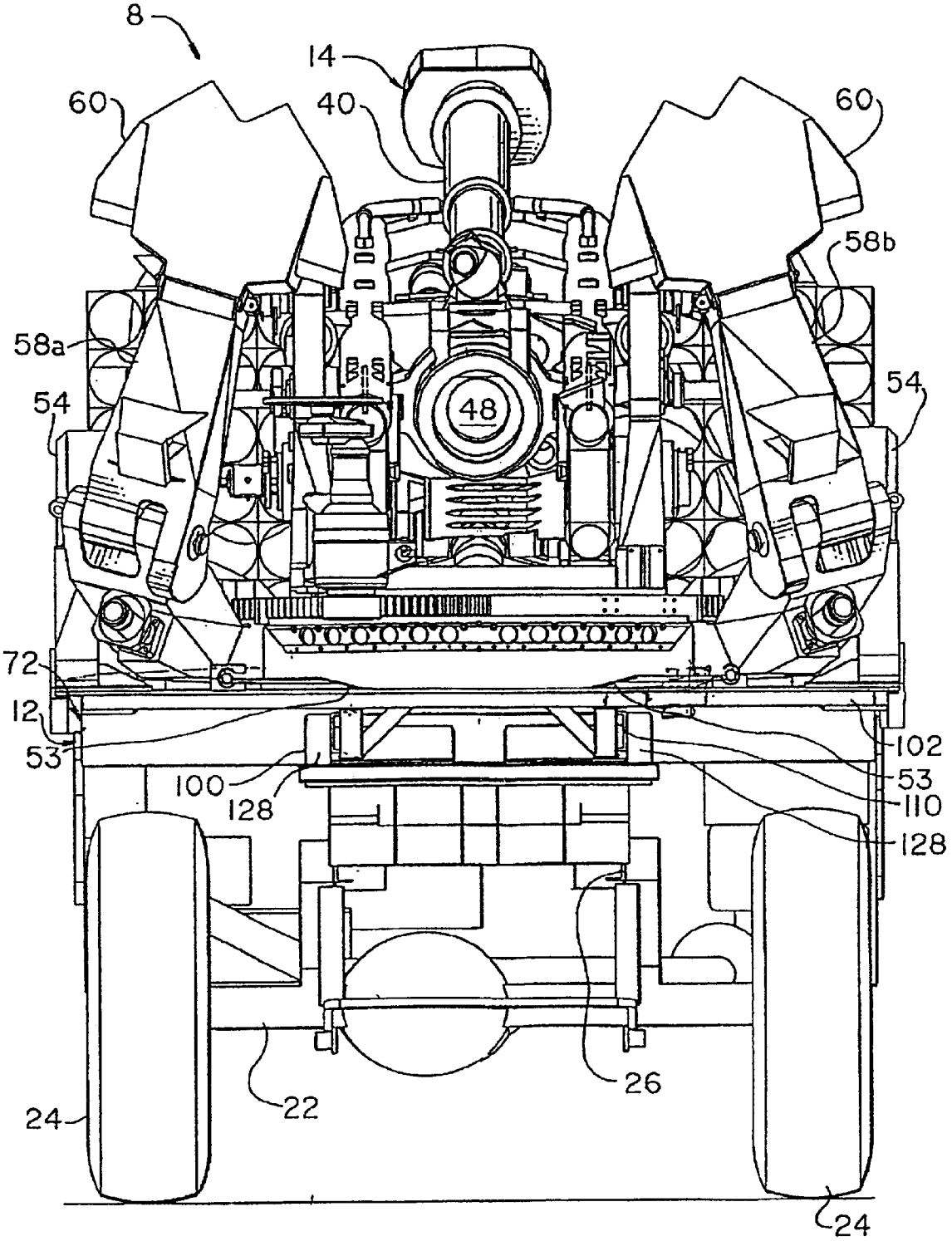
FIG. 4 is a rear elevational view of the cannon system.
Figure 5:
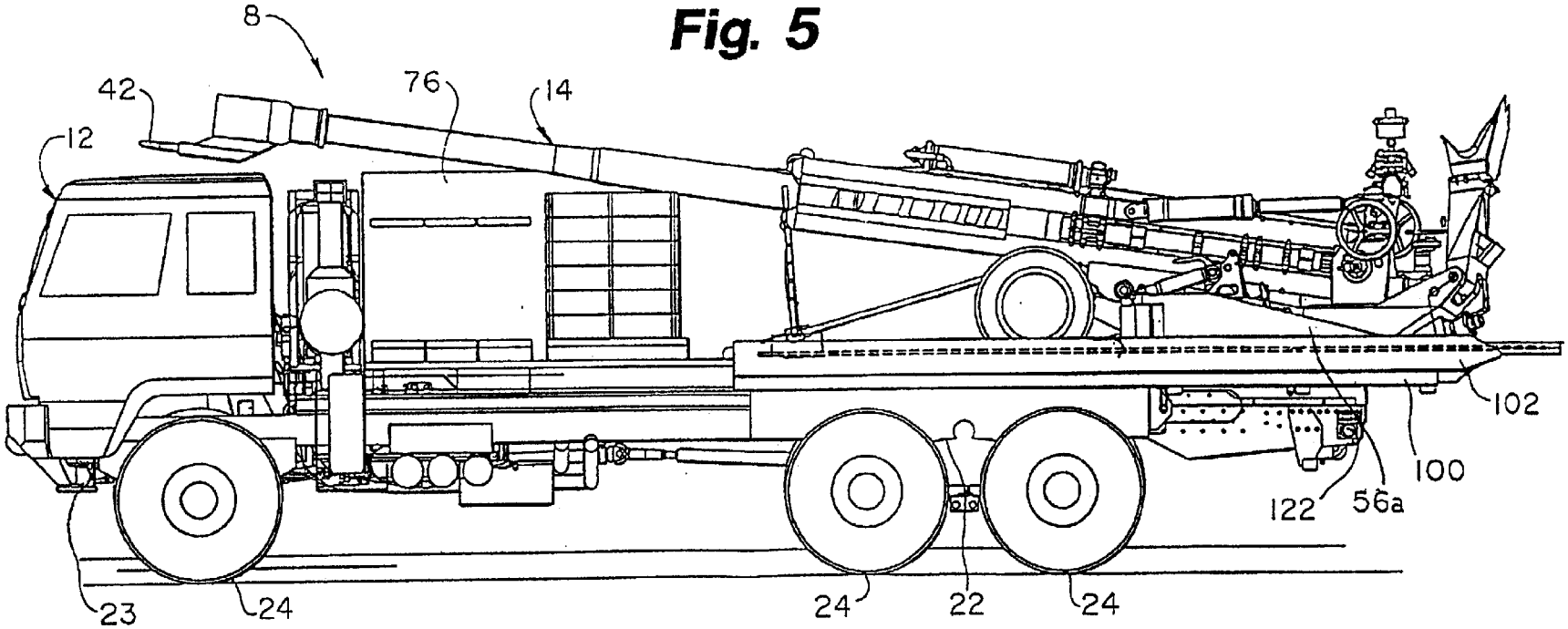
FIG. 5 is a side elevational view of the cannon system as depicted in FIG. 3.

Turning now to the tilt bed system 10 of the cannon system 8, the tilt bed system 10 has two major subcomponents; stationary bed 70 and tilt bed 72. The stationary bed 70 is supported by the frame 26 of the vehicle 12. The stationary bed 70 presents an upward directed support surface 74. A plurality of ammunition storage containers 76 are disposed on a portion of the stationary bed 70. In the embodiment of FIG. 1, the ammunition storage containers 76 are disposed on the forward portion of the stationary bed 70, leaving a space rearward thereof for the storage of other equipment useful in tactically deploying the howitzer 14. In the embodiment of FIG. 2, the ammunition storage containers 76 are disposed rearward on the stationary bed 70. A relatively small optional crew cab 78 is disposed forward of the ammunition storage containers 76.

The howitzer 14 is preferably designed to be served by a minimum crew of five gunners. Three of such individuals may be transported in the cab 28 of the vehicle 12. The remaining two gunners may be transported in the optional crew cab 78. The crew cab 78 preferably has two facing jump seats as well as storage room for the personal effects of the two gunners transported therein. The crew cab 78 may be formed of fiberglass material and may have side entry doors, a rear entry door and windows as desired.

At least one gravity conveyor 80 may be disposed on the support surface 74. The gravity conveyor 80 is a ladder like structure comprised of two parallel longitudinal rails supporting a number of transverse axles containing multiple free spinning wheels. When disposed at an incline, objects placed at the higher end will travel to the lower end, propelled by gravity. The gravity conveyor 80 may be deployed laterally from the stationary bed 70 to feed ammunition to the howitzer 14 when the howitzer 14 is disposed alongside the vehicle 12. See FIGS. 8*a*, 8*b*. Alternatively, the gravity conveyor 80 may be deployed down the tilt bed 72 when the tilt bed 72 is in a tilted disposition to feed ammunition to the howitzer 14 when the howitzer 14 is positioned rearward of the vehicle 12.

The second major component of the tilt bed system 10 is the tilt bed 72. The tilt bed 72 is further comprised of a tilt frame assembly 100 and a tilt bed assembly 102. The tilt frame assembly 100 and tilt bed assembly 102 are best viewed in FIGS. 1–5 and 13–16.

The tilt frame assembly 100 of the tilt bed 72 includes a subrail 104. The subrail 104 is mounted on the upper surface of the frame 26 of the vehicle 12. The subrail 104 includes two opposed C-section sides 106 coupled by a top plate 110. A pair of elongate side gussets 108 may be utilized to couple the subrail 104 to the frame 26 as by welding along the side gussets 108 or the like. The subrail 104 extends substantially the full length of the bed area of the vehicle 12. In a preferred embodiment, the height of the C-section sides 106 is less than six inches and more preferably is about 5.2 inches. Strengthening cross members may be disposed between the inner margins of the two C-section sides 106.

Figure 15:
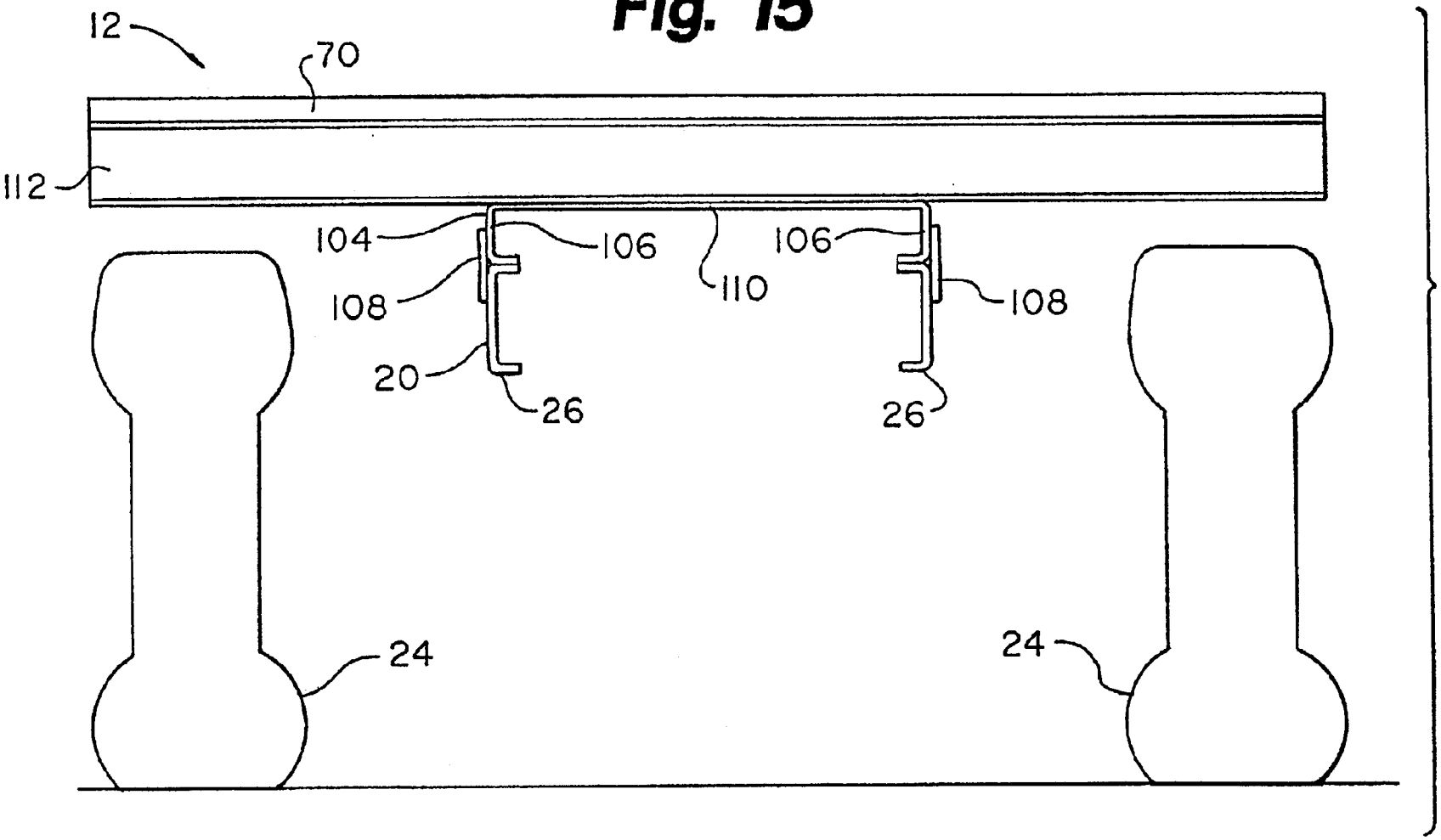
FIG. 15 is an end view of the stationary bed supported on the vehicle chassis.

Since the subrail 104 extends substantially the full length of the bed portion of the vehicle 12, the subrail 104 supports both the stationary bed 70 and the tilt bed 72. The support for the stationary bed 70 is depicted in FIG. 15. The plurality of cross members 112 extend widthwise across the top plate 110 of the subrail 104. The cross members 112 support the stationary bed 70. A depending cylinder bracket 114 may be fixedly coupled to the outer margin of a C-section side 106 and to the outer margin of the underlying portion of the frame 26. The depending cylinder bracket 14 defines a cylinder hinge point 118 for coupling a first end of a cylinder 116 to the depending cylinder bracket 114. A first cylinder hinge pin 120 pivotally couples the cylinder 116 to the depending cylinder bracket 114.

A depending hinge bracket 121 is disposed proximate the rear margin of the subrail 104. A bed hinge point 122 is disposed in the depending hinge bracket 121. A bed hinge pin 124 may be disposed within the bore defining the bed hinge point 122.

The second component of the tilt frame assembly is the tilt frame 126. The tilt frame 126 includes spaced apart elongate rails 128. In a preferred embodiment, the elongate rails 128 may be comprised of box section steel. The lateral dimension between the two spaced rails 128 may be slightly greater than the lateral dimension between the outside margins of the two C-section sides 106.

A depending cylinder bracket 130 may be fixedly coupled to a selected rail 128 proximate the forward margin of the rail 128. The depending cylinder bracket defines a cylinder hinge point 132 by means of a bore defined therein. A second cylinder hinge pin 134 may be disposed in the cylinder hinge point 132 to pivotally couple the second end of the cylinder 116 to the tilt frame 126.

A depending tilt bracket 136 depends from each of the two rails 128. A bore is defined in the depending tilt bracket 136 which defines a bed hinge point 138. The bed hinge point 138 is in registry with the bed hinge point 122 and is pivotally coupled thereto by the bed hinge pin 124.

A tow pintle 140 is disposed proximate the rear margin of the rails 128. The pintle 140 has a pintle lower margin 142. As will be seen, the pintle lower margin 142 comes into contact with the ground surface when the tilt frame 126 is in a tilted disposition to assist in supporting the tilt frame assembly 100, the tilt bed assembly 102 and the howitzer 14 when the howitzer 14 is disposed on the tilt bed assembly 102.

The second major component of the tilt bed 72 is the tilt bed assembly 102. It is important to realize that the tilt bed assembly 102 is translationally, shiftably disposed relative to the tilt frame assembly 100. Accordingly, the tilt bed assembly 102 is tiltable by the tilt frame assembly 102 and may translate rearward/forward relative to the tilt frame assembly 100 to effectively extend the tilt bed 72 rearward for loading the howitzer 14 from a disposition on the ground.

Figure 16:
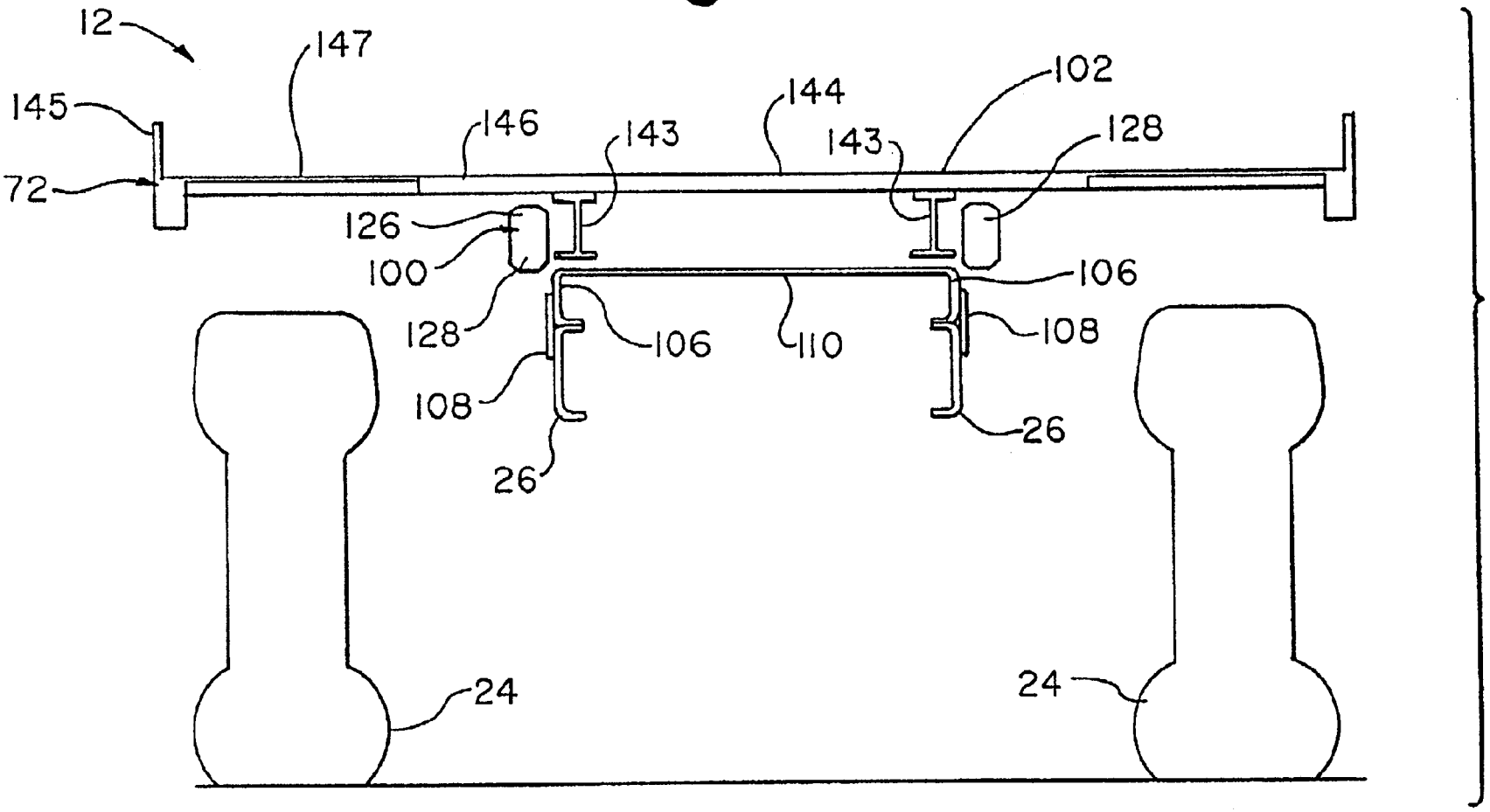
FIG. 16 is an end view of the tilt bed supported on the vehicle chassis.

Referring to FIG. 16, the tilt bed 144 is supported on a pair of spaced apart I beams 143. The I beams 143 extend substantially the full length dimension of the tilt bed assembly 102. The I beams 143 are disposed inward of the elongate rails 128 of the tilt frame 126.

Referring to FIGS. 2 and 16, the tilt bed 144 has upward directed edges 145 on either side of the load surface 146. A wheel relief 147 is preferably defined in the underside of the load surface 146 to accommodate the wheels 24 of the vehicle 12. A base plate receiver 148 is designed in the load surface 146. The base plate receiver 148 is designed to receive and to lock in place the base plate 53 of the howitzer 14.

A powered guide system 150 is disposed on the load surface 146. The powered guide system has components that translate along the longitudinal axis of the tilt bed 144. Such components are preferably hydraulically powered and assist in loading and unloading the howitzer 14 onto the tilt bed 72.

The powered guide system 150 includes a track 152. A guide device 154, depicted in FIG. 1, is designed to ride in the track 152. The guide device 154 is designed to be couplable to a variable height draw bar 156, as depicted in FIG. 1.

The variable height draw bar 156 includes a generally upward directed tube bar 158 that is attachable by a tube coupling 160 to the tube 40 of the howitzer 14. A generally rearward directed cradle bar 162 is attachable by a cradle coupling 164 to the cradle 50 of the howitzer 14.

It is understood that the bars 158, 162 of the variable height draw bar 156 are semi-rigid such that in addition to pulling the howitzer 14 up onto the tilt bed 72, the bars 158, 162 restrain any tilting moment that occurs in the howitzer 14 during transition on the tilt bed 72. Additionally, the bars 158, 162 are comprised of telescoping bar segments 166. The telescoping bar segments 166 permit the semi-rigid length of the bars 158, 162 to be varied in order to hold the howitzer 14 in various longitudinal dispositions on the tilt bed 72 as well as to elevate and depress the tube 40 relative to the tilt bed 72 as desired.

Figure 6A:
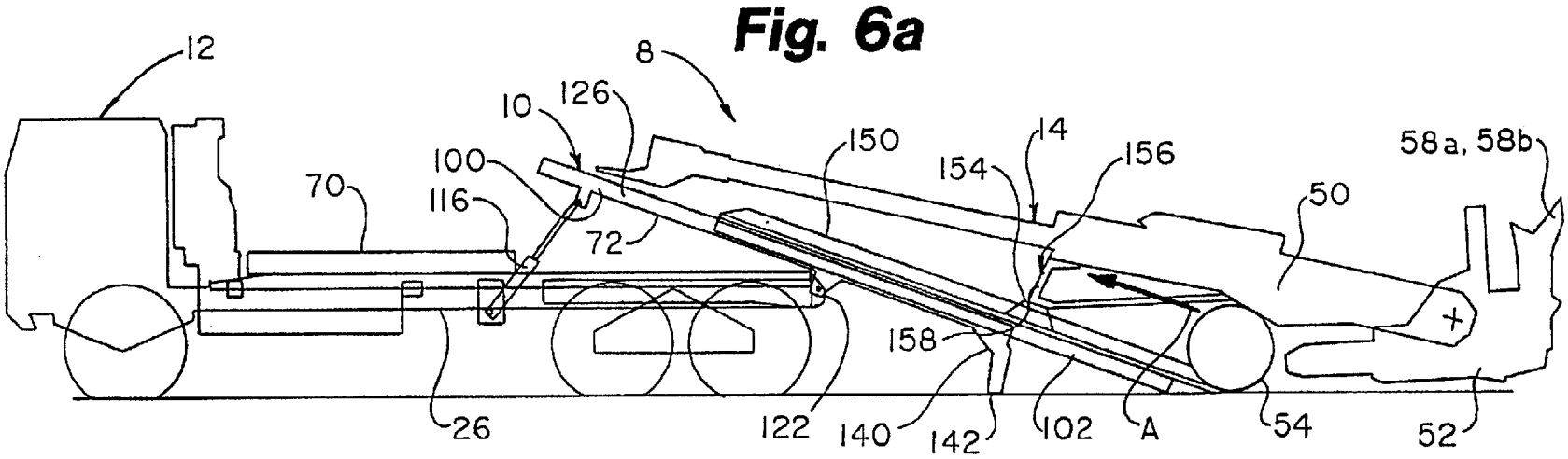
FIGS. 6*a*–6*g* depict a loading sequence taking the howitzer from disposed rearward of the vehicle to the transport disposition on the vehicle.

Loading operations for loading a howitzer 14 onto the vehicle 12 by means of a tilt bed system 10 are depicted in FIGS. 6*a*–6*h*. Referring to FIG. 6*a*, a depiction of the howitzer 14 just starting to move up the tilt bed assembly 102 is provided. Prior to commencing such motion as indicated by the arrow A, the cylinder 116 is extended to tilt the tilt bed 72 relative to the frame 26 of the vehicle 12. The tilt bed 72 is tilted a sufficient amount such that the lower margin 142 of the tow pintle 140 is in contact with the surface upon which the vehicle 12 is resting. The tilt bed assembly 102 is translated rearward relative to the tilt frame assembly 100 until the rear margin of the tilt bed assembly 102 is also in contact with the surface. The guide device 154 is translated rearward in the track 152 of the powered guide system 150. The guide device 154 is operably coupled to the howitzer 14 by means of the variable height draw bar 156. Preferably, the cradle 50 of the howitzer 14 is at a plus 15° angle relative to the undercarriage 52. The suspension of the howitzer 14 is adjusted such that the bottom tangent of the wheel 54 is close to the plane of the undercarriage 52 base. The stabilizers 56*a*, 56*b* are folded back and the trails 58*a*, 58*b* are raised to the transport disposition. As depicted in FIG. 6*a*, the guide device 154 has just started to move the howitzer 14 up the tilt bed assembly 102. It should be noted that the variable height draw bar 156 is counteracting the center of gravity moment of the howitzer 14 to maintain the undercarriage 52 elevated above the surface.

Figure 6B:
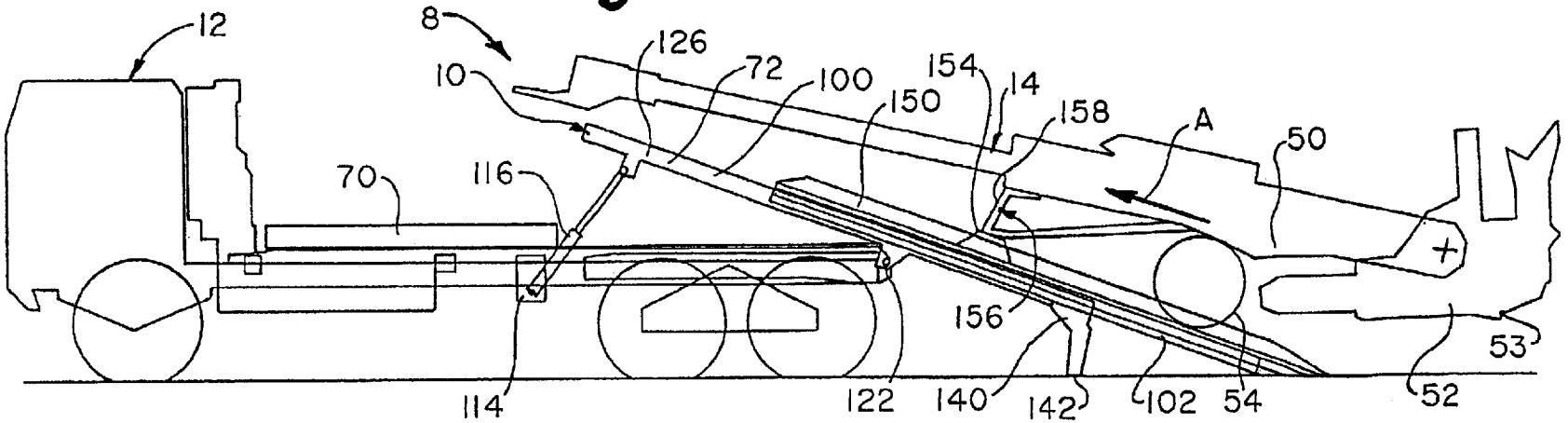

Referring to FIG. 6*b*, the motion depicted by arrow A has drawn the howitzer 14 upward on the tilt bed assembly 102. The depiction of FIG. 6*b* shows the howitzer 14 disposed at an intermediate disposition between the depiction of FIG. 6*a* and that of FIG. 6*c*.

Figure 6C:
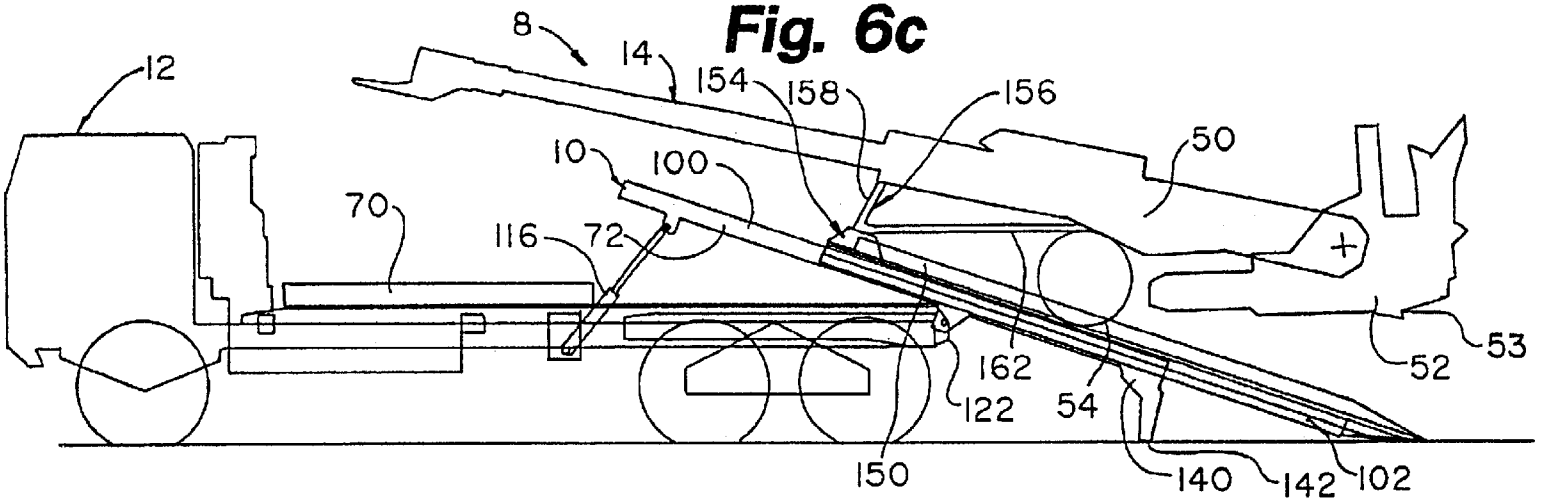

In FIG. 6*c*, upward motion of the howitzer 14 onto the tilt bed assembly 102 has stopped, as indicated. The guide device 154 of the powered guide system 150 has translated to its forwardmost disposition on the tilt bed assembly 102.

Figure 6D:
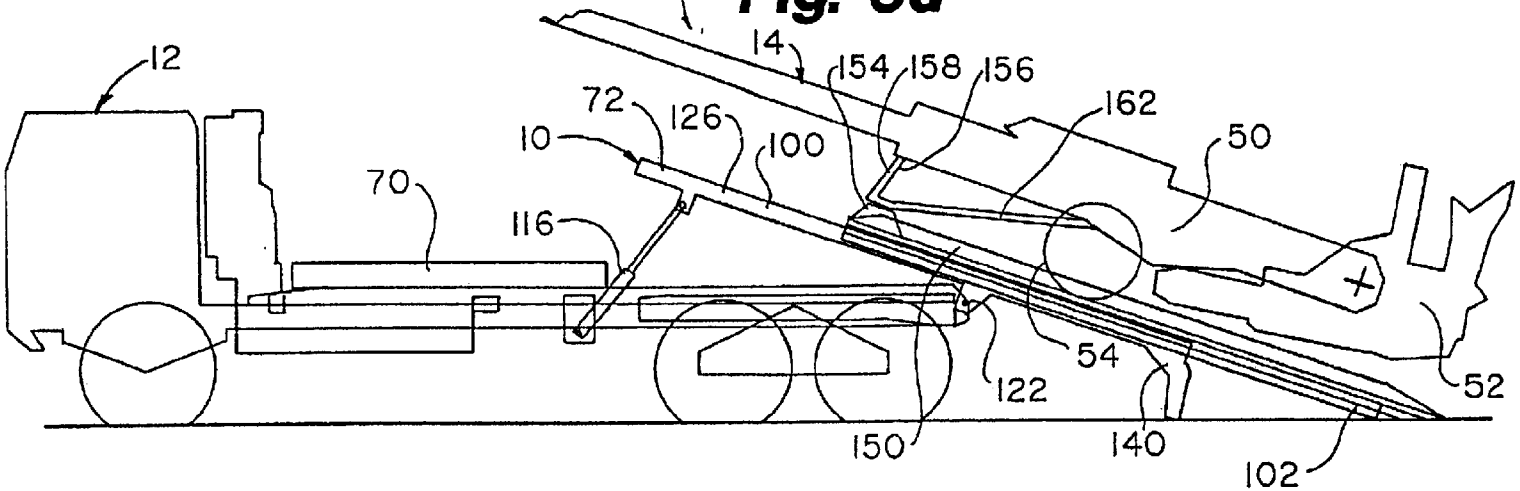

In the depiction of FIG. 6*d*, the howitzer 14 remains at the same disposition on the tilt bed assembly 102 as depicted in FIG. 6*c*. The undercarriage 52 is rotated relative to the cradle 50 of the howitzer 14 such that the cradle 50 is at a +8° angle relative to the undercarriage 52. In such disposition, the lower margin of the undercarriage 52 is not in contact with the load surface 146 of the tilt bed assembly 102.

Figure 6E:
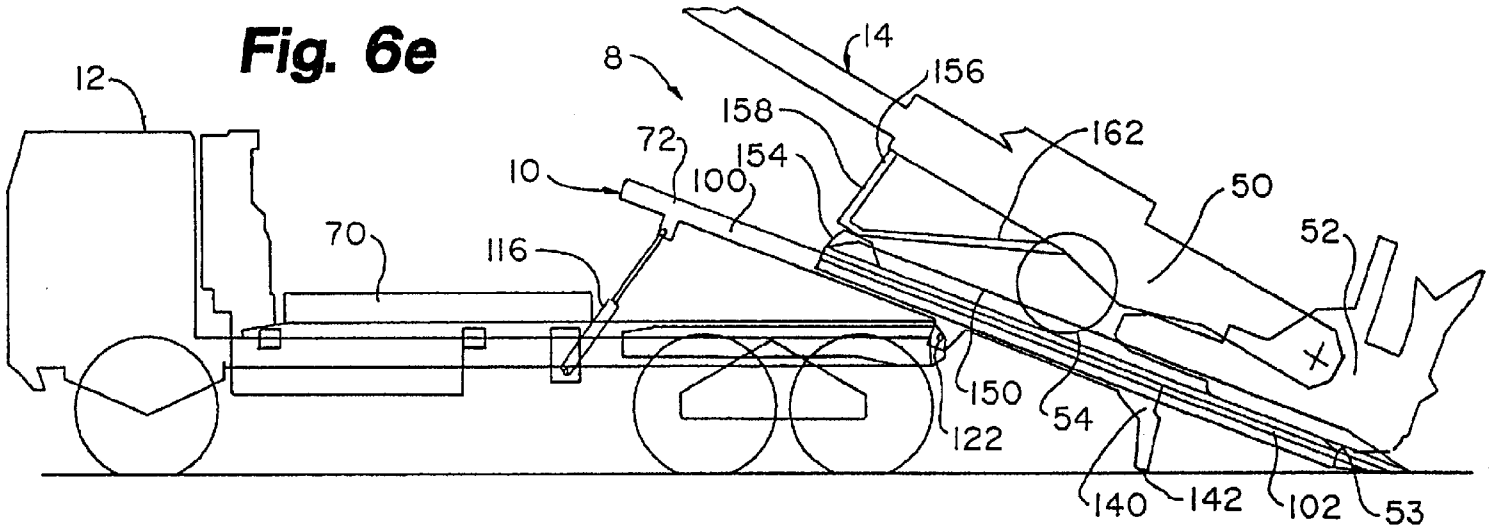

Referring now to FIG. 6*e*, the configuration of the howitzer 14 remains as depicted in FIG. 6*d*. The tube bar 158 of the variable height draw bar 156 is extended, lowering the undercarriage 52 to the load surface 146 of the tilt bed assembly 102. In such disposition, the base plate 53 is engaged with and locked into the base plate receiver 148 disposed on the tilt bed assembly 102.

Figure 6F:
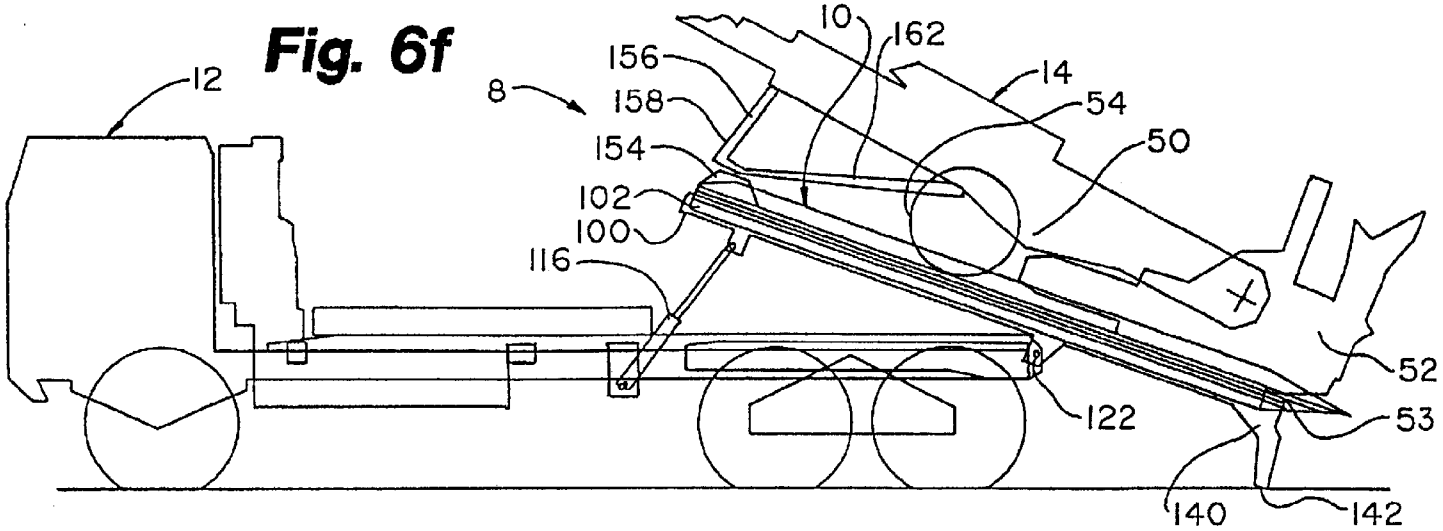

As depicted in FIG. 6*f*, once the howitzer 14 is locked to the tilt bed assembly 102, the tilt bed assembly 102 is translated forward relative to the tilt frame assembly 100 such that the leading edge of the tilt bed assembly 102 is substantially coincident with the leading edge of the tilt frame assembly 100. Such action withdraws the rear margin of the tilt bed assembly 102 from contact with the surface.

Figure 6G:
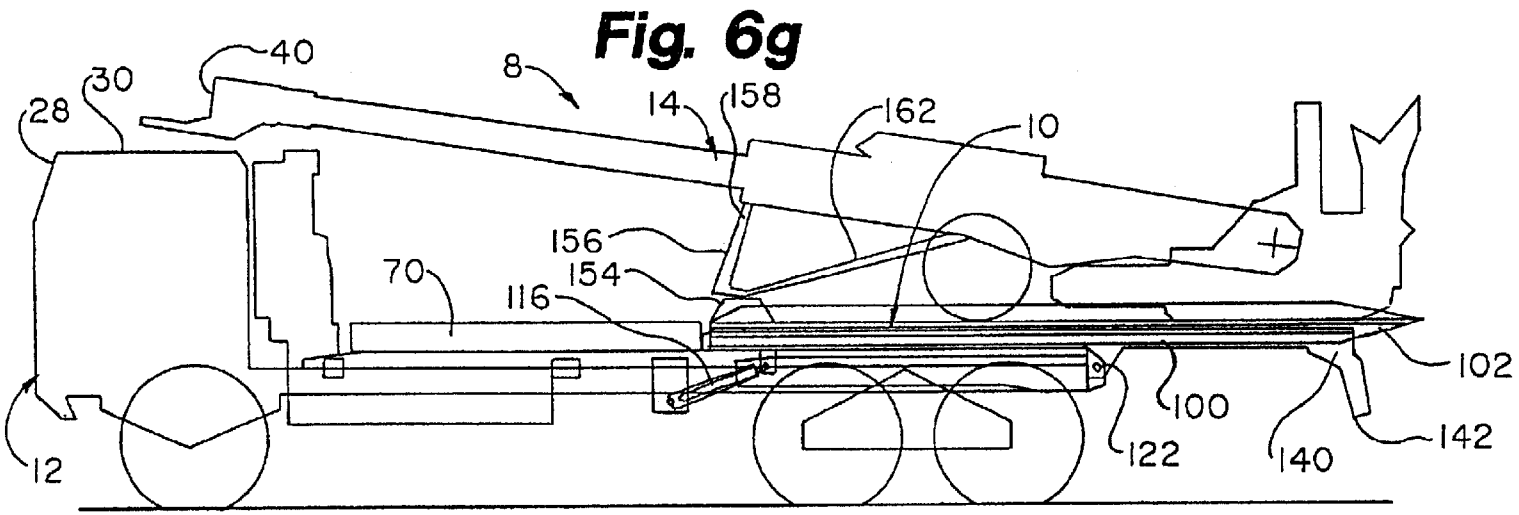

The transport disposition of the howitzer 14 on the vehicle 12 is depicted in FIG. 6*g*. The cylinder 116 is retracted to lower the tilt bed 72 under the subrail 104. The muzzle 44 of the howitzer 14 partially overlies the cab roof 30 of the cab 28.

FIG. 7 depicts the cross sectional dimensions of the cargo bay of the C-130 aircraft. It is the envelope defined by these dimensions into which the cannon system 8 must be disposed for transport of the cannon system 8 by a single C-130 aircraft. A critical dimension of the envelope is the height dimension. In the transport disposition of FIG. 6*g*, the upper margin of the muzzle 40 is the highest element of the cannon system 8. As such, the cannon system 8 is not able to be disposed within the envelope of the cargo bay of the C-130 type aircraft.

Figure 6H:
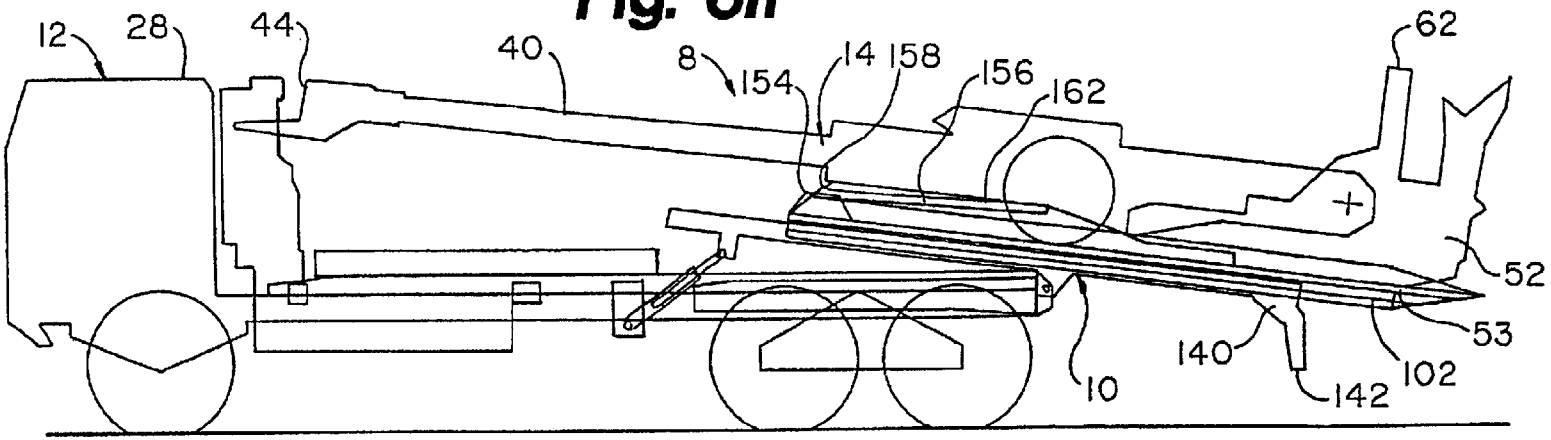
FIG. 6*h* is a side elevational view of the cannon system in the aircraft transport disposition.

Referring now to FIG. 6*h*, the cannon system 8 is depicted in the C-130 transport disposition. In such disposition, the howitzer 14 remains locked to the tilt bed assembly 102 as previously described. The tube bar 158 of the variable height draw bar 156 is retracted to its shortest dimension while the cradle 50 of the howitzer 14 is depressed to −1° relative to the undercarriage 52. In the C-130 transport disposition, the muzzle 40 may not overlie the cab 28. Accordingly, the cylinder 116 is extended somewhat in order to tilt the tilt bed 72 at a preferably 7.5° angle relative to the transport disposition. Additionally, the tilt bed assembly 102 is translated rearward relative to the tilt frame assembly 100 a preferred distance of about 35 inches. In such disposition, the highest component of the howitzer 14 becomes the optical sight mounts 62. It has been shown that in the disposition depicted in FIG. 6*h*, the optical sight mounts 52 have a elevation about the surface upon which the vehicle 12 is resting that is sufficiently low to clear the upper limit of the envelope of the cargo area of the C-130 type aircraft. In order to stabilize the tilt bed 72 in the disposition depicted in FIG. 6*h*, mechanical locks are added to the cylinder 16 to mechanically lock it in place. Further, mechanical locks are added to the tilt bed assembly 102 to lock the tilt bed assembly 102 to the tilt frame assembly 100. Such locks may be as simple as disposing pins in bores brought into registry, the bores being formed in both the tilt bed assembly 102 and the tilt frame assembly 100.

Figure 9:
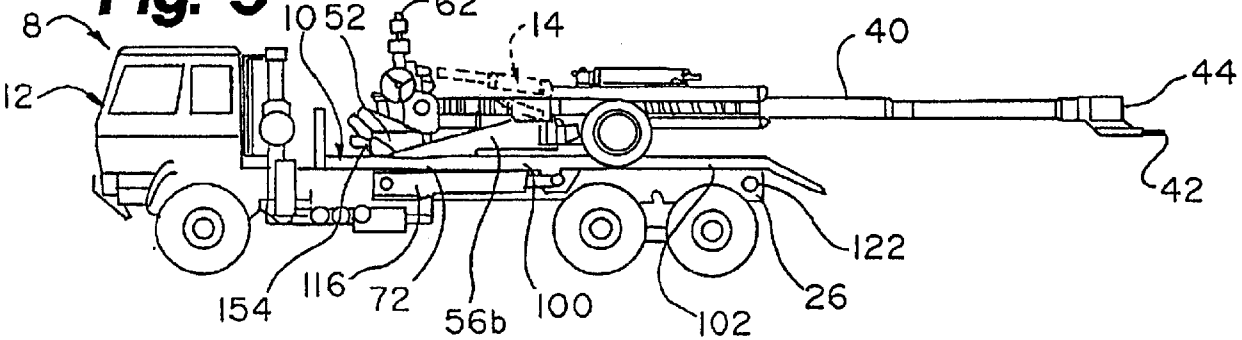
FIG. 9 is a side elevational view of the cargo area of a C-130 aircraft with an alternative embodiment of the cannon system disposed therein.
Figures 8A, 8B:
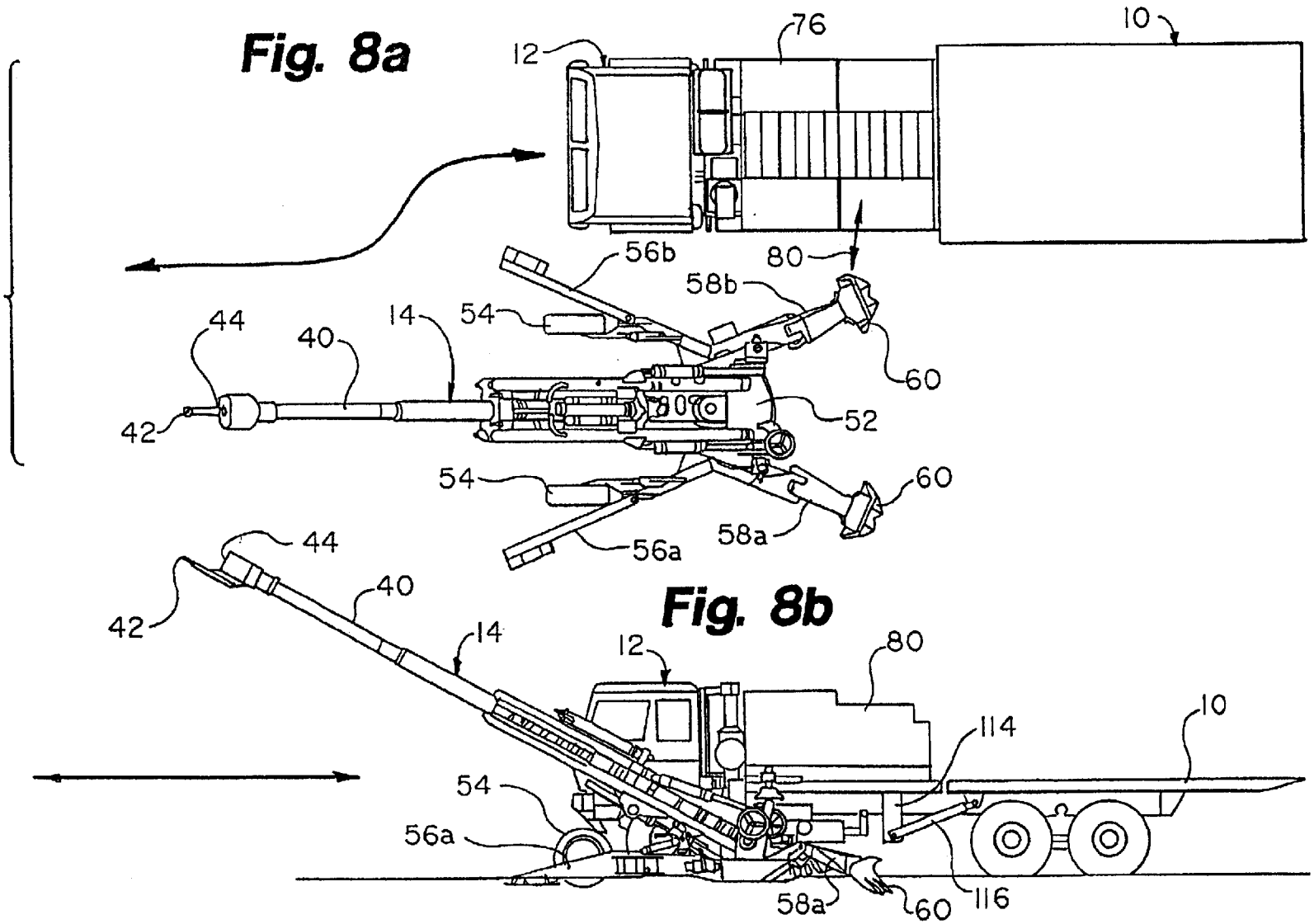
FIG. 8*a* is a top plan form view of the howitzer disposed along side the vehicle in a tactical disposition showing ammunition flow from the vehicle to the howitzer.
FIG. 8*b* is a side elevational view of the cannon system of FIG. 8*a*.

A second embodiment of the present invention is depicted in FIGS. 9–13*a*. The depiction of FIG. 9 shows a relatively short wheelbase vehicle 12. Such vehicle 12 includes a tilt bed 72 but does not include a stationary bed 70 as described with reference to the embodiment above. The tilt bed 72 includes both a tilt frame assembly 100 and a tilt bed assembly 102. The tilt bed 72 is tilted by a cylinder 116 about the bed hinge point 122. The tilt bed assembly 102 translates rearward relative to the tilt frame assembly 100 in order to place the rear margin of the tilt bed assembly 102 in contact with the surface underlying vehicle 12 when the tilt bed 72 is in the tilted disposition.

The tilt bed 72 includes a powered guide system 150. The powered guide system 150 includes a translatable guide device 154 that is movable along a track 152. The guide device 154 includes a first portion of a quick hitch. A second portion of the quick hitch is affixed to the lower rear margin of the undercarriage 52 of the howitzer 14. The guide device 154 is secured to the howitzer 14 by the quick hitch. An advantage of the embodiment of FIG. 9 is that the center gravity moments of the howitzer 14 are accommodated by securely affixing the undercarriage 52 to the guide device 154. Accordingly, no variable height draw bar 156 is needed as described with reference to the embodiment above.

The embodiment of FIGS. 9–13*a* utilizes a vehicle 12 substantially similar to the vehicle 12 described with reference to the embodiment of FIGS. 1–5. The vehicle 12 has a long wheelbase and includes a fishplate 32. In the embodiment of FIGS. 9–13*a*, the fishplate 32 is utilized in its full length and is not truncated as was indicated with reference to the embodiment of FIGS. 1–5. While not shown, it is clear that an optional two-man crew cab as depicted in FIG. 1 could be incorporated into the embodiment of FIGS. 9–13*a* by reducing the amount of ammunition carried and shifting the ammunition rearward.

Figure 10:
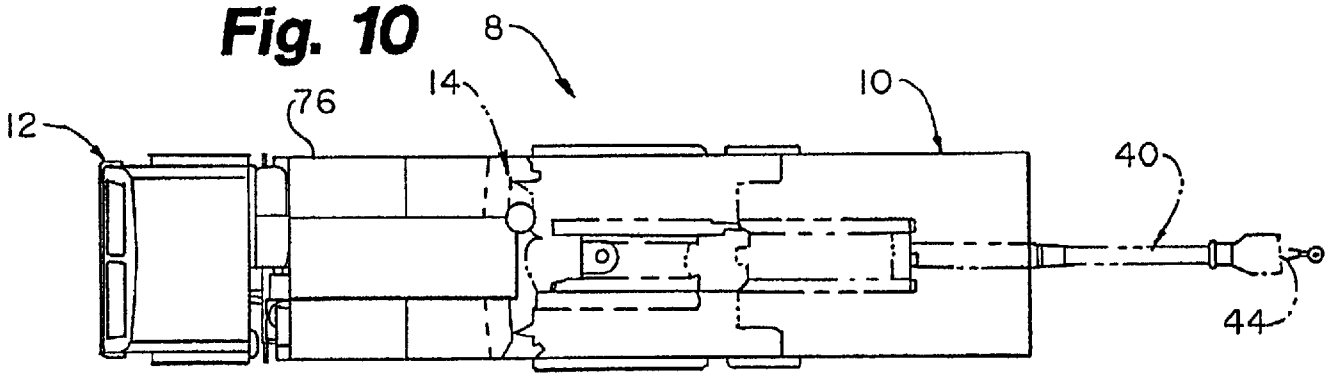
FIG. 10 is a top planform view of the cannon system of the present invention on a long wheelbase vehicle.
Figure 11:
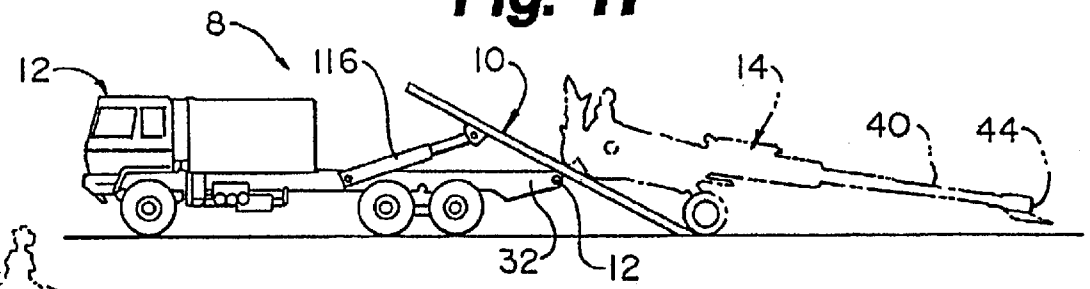
FIG. 11 is a side elevational view depicting the howitzer immediately prior to loading onto the vehicle of FIG. 10.
Figure 12:
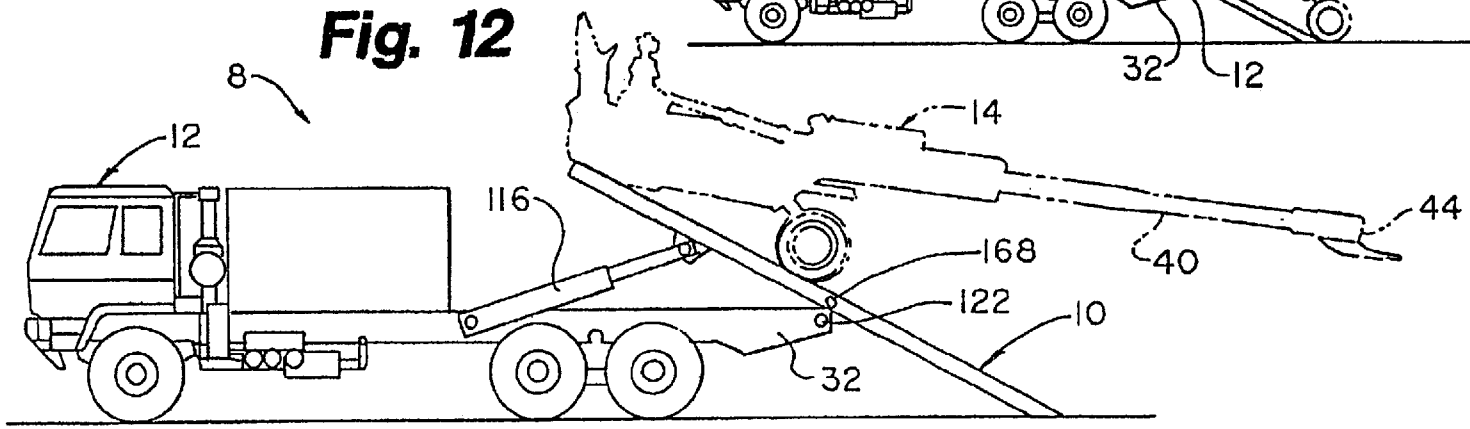
FIG. 12 is a side elevational view of the howitzer loaded onto the tilt bed of the vehicle prior to tilting the tilt bed to a substantially horizontal disposition.

FIG. 10 depicts the cannon system 8 in the transport disposition in which the howitzer is moved on the vehicle 12 to a tactical disposition. FIG. 11 depicts the howitzer 14 just prior to pulling the wheels 54 onto the tilt bed assembly 102. In this embodiment, the guide device 154 is translatable to proximate the rear margin of the tilt bed assembly 102. In such disposition, the guide device 154 is connectable to the howitzer 14 by the quick hitch device, the second portion of which is disposed at the lower rear margin of the undercarriage 52 of the howitzer 14. In the depiction of FIG. 11, the guide device 154 has translated approximately half the distance of the track 152. Turning now to FIG. 12, the guide device 154 is translated virtually to the forward margin of the track 152 at the forward margin of the tilt bed assembly 102.

Figure 13:
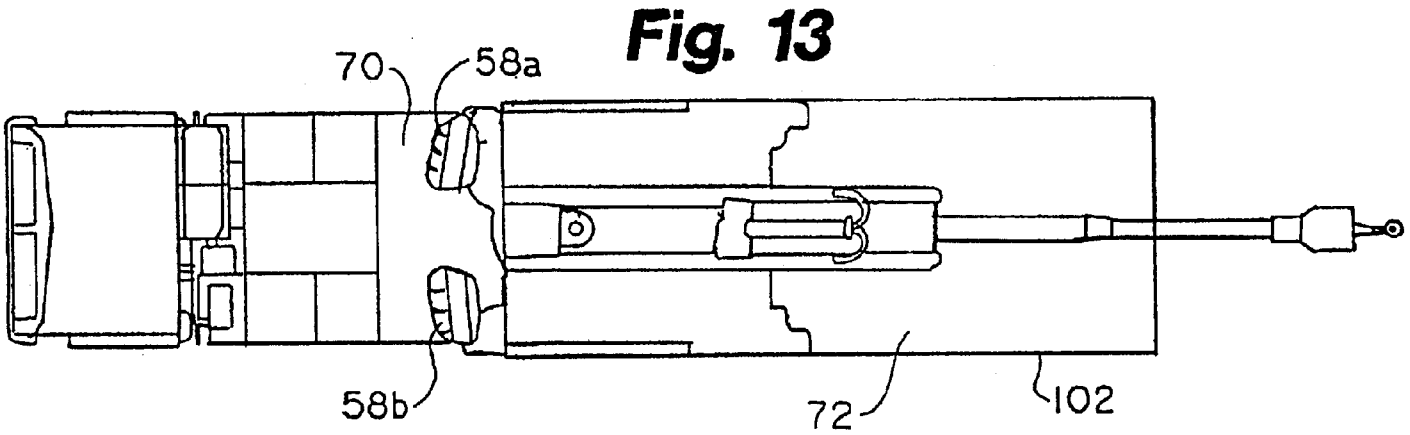
FIG. 13 is a top planform view of the cannon system in the aircraft transport disposition.
Figure 13A:
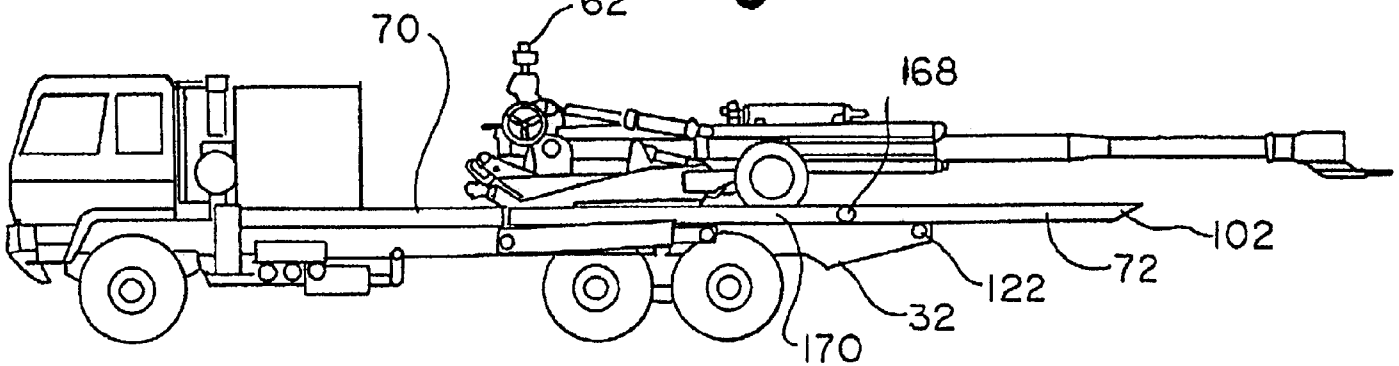
FIG. 13*a* is a side elevation view of the cannon system in the aircraft transport disposition.
Figure 14:
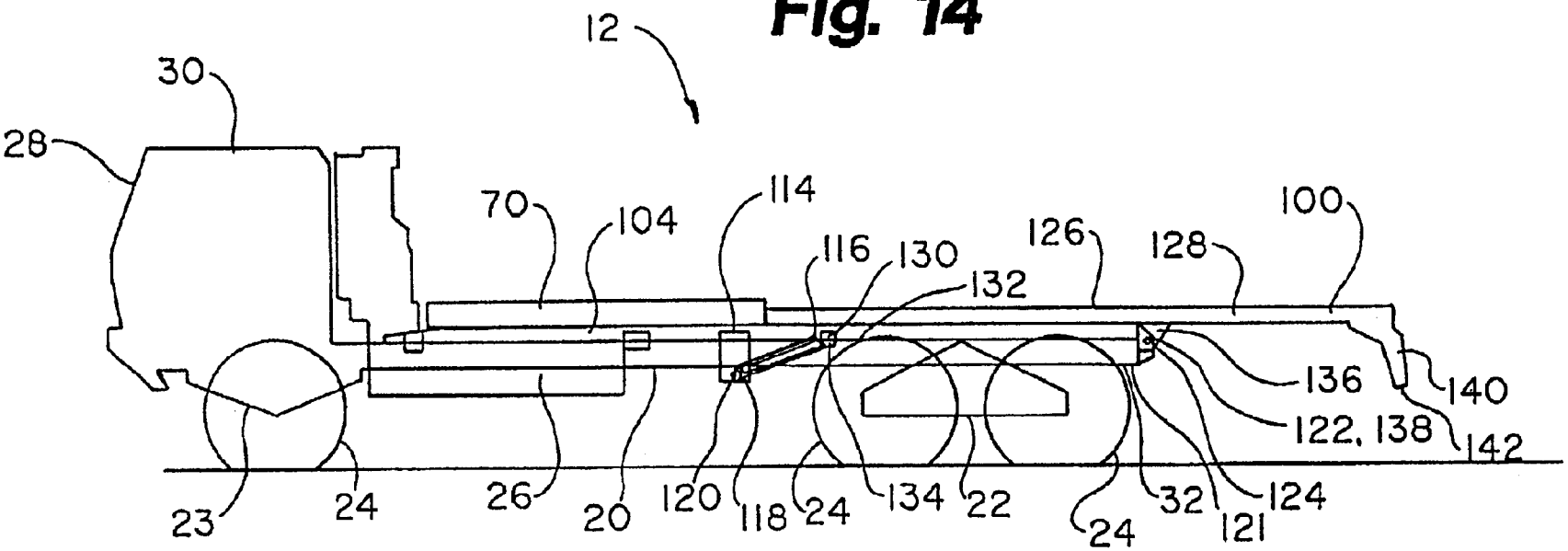
FIG. 14 is a side elevational view of the vehicle without the tilt bed assembly.

FIGS. 13 and 13*a* depict the cannon system 8 in the C-130 transportable disposition. It should be noted in comparing FIGS. 12 and 13*a* that the point on the tilt bed assembly 102 about which the tilt bed assembly 102 pivots moves rearward from the down and locked disposition of FIG. 13*a* to the raised, tilted disposition of FIG. 12. Note the mark 168 in FIG. 13*a*. This mark 168 moves rearward to a disposition immediately above the bed hinge point 122 in FIG. 12. The tilt bed assembly 102 is drawn downward from the disposition of FIG. 12 to the disposition of FIG. 13*a* it is also drawn forward such that the forward margin of the tilt bed assembly 102 is proximate the rear margin of the stationary bed 70.

The depictions of FIGS. 13 and 13*a* depict the cannon system 8 in the C-130 transportable disposition. It should be noted that the extendible trails 58*a*, 58*b* depicted in FIG. 13, are not depicted in FIG. 13*a*. In order to meet the envelope requirements of the cargo area of the C-130 type aircraft, the howitzer 14 is drawn forward on the tilt bed assembly 102 such that a significant portion of the howitzer 14 overlies the stationary bed 70. Further, the cradle 50 is at substantially 0° elevation with respect to the undercarriage 52 of the howitzer 14. When the howitzer 14 is drawn forward, the extendible wheels 54 of the howitzer 14 reside within wheel cutouts 170 defined in the load surface 146 of the tilt bed assembly 102. The underside of the carriage 52 is resting on the load surface 146. It will be noted in this disposition that the optical sight mounts 62 are the highest point of the cannon system 8. In order to accommodate this elevation within the cargo envelope of the C-130 aircraft, the suspension 22, 23 of the vehicle 12 is compressed and a certain amount of air is let out of the wheels 24. Such action reduces the overall height of the cannon system 8 by approximately seven inches thereby allowing the cannon system 8 to fit within the envelope of the cargo area of a C-130 type aircraft.

Figure 17:
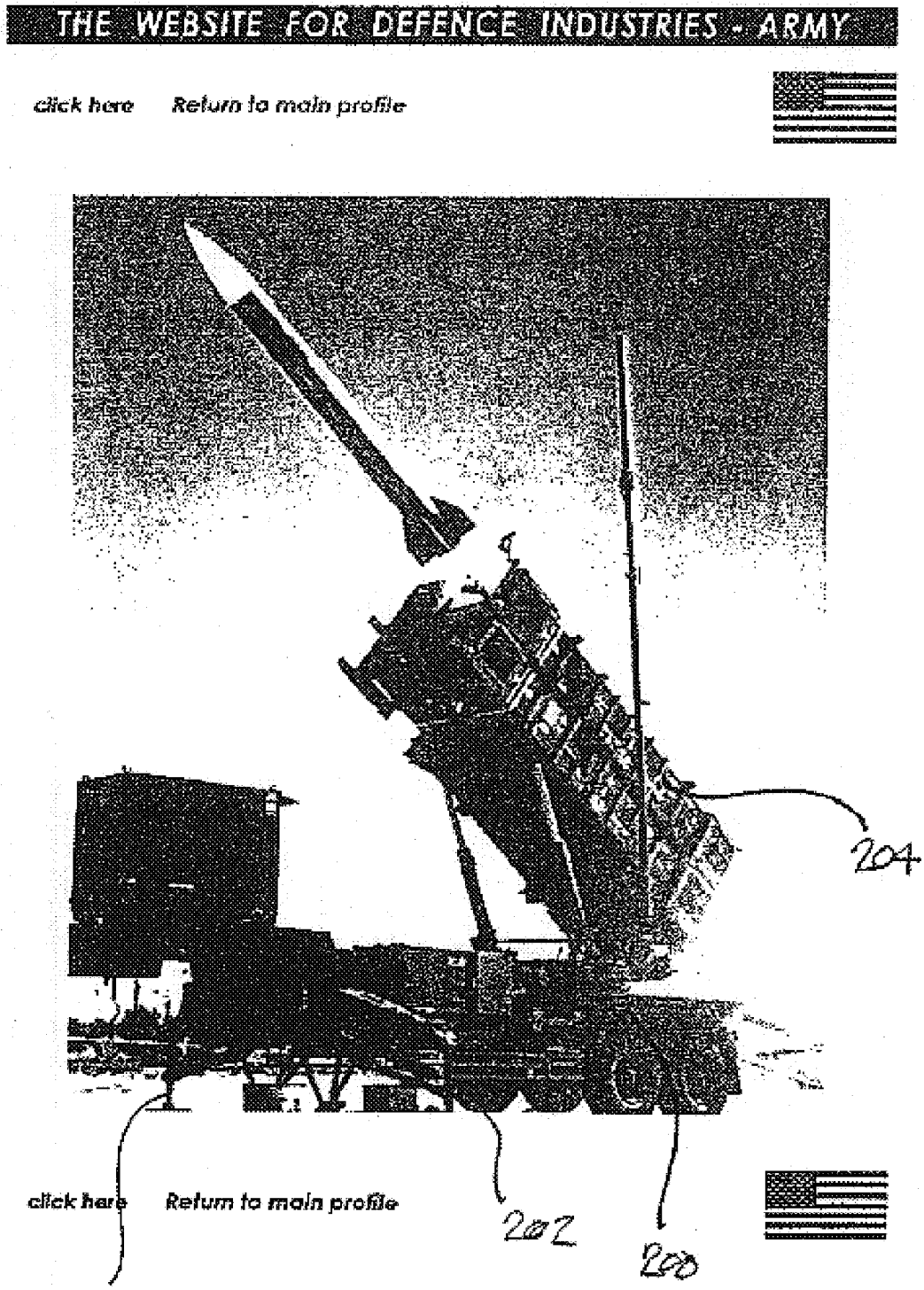
FIG. 17 PRIOR ART
FIG. 17 is a perspective view of a missile launcher mounted on a prior art dedicated trailer.
Figure 18:
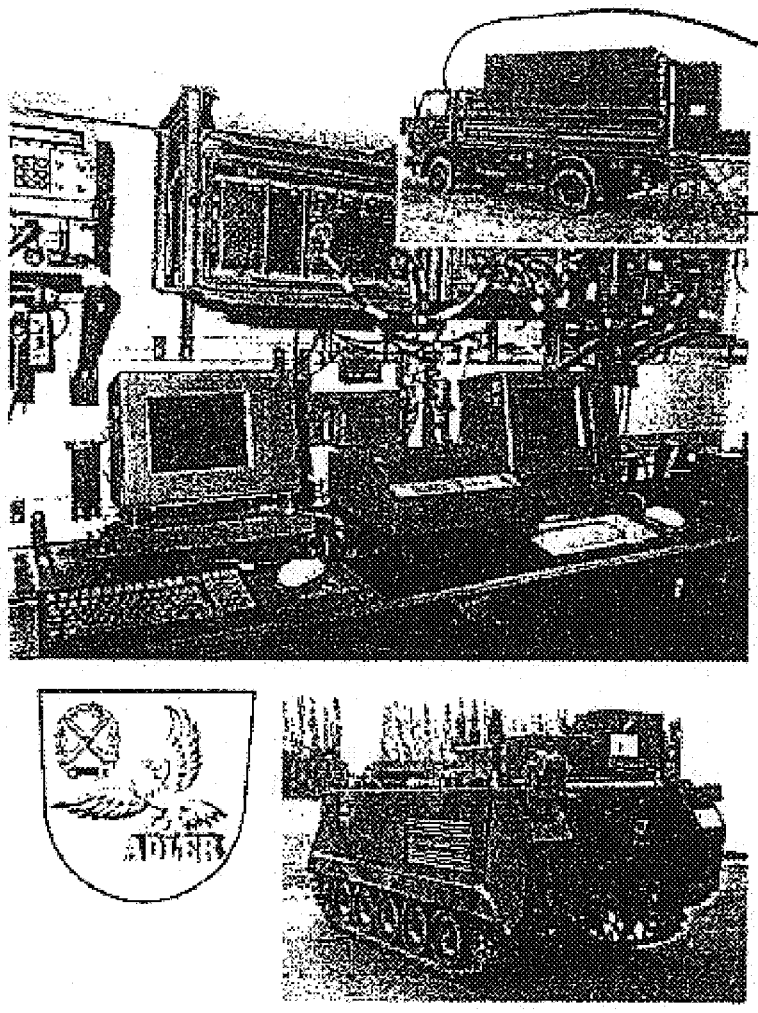
FIG. 18 PRIOR ART
FIG. 18 is a plurality of perspective depictions of a computer network mounted on a prior art dedicated truck.

The tilt bed system 10 mounted on a vehicle 12 of the present invention also allows the containerization/palletizing of some mission equipment that is currently mounted on dedicated trailers 200 (see prior art FIG. 17) or is permanently mounted on a dedicated truck chassis, such as radars, generator sets, command centers, communications sets, and maintenance vans. Often the use of these pieces of mission equipment requires the deployment of outriggers and stabilizers 202 (see prior art FIG. 17) to provide a satisfactorily stable base for operation of rotating antennas, missile launchers 204, generators, etc., and/or they require the deployment of stairs/steps 206 to span the significant distance from the ground to the disposition on a dedicated truck chassis 208 (see prior art FIG. 18) to allow safe access by operators to command centers, tactical operation centers, or maintenance facilities.

Figure 19:
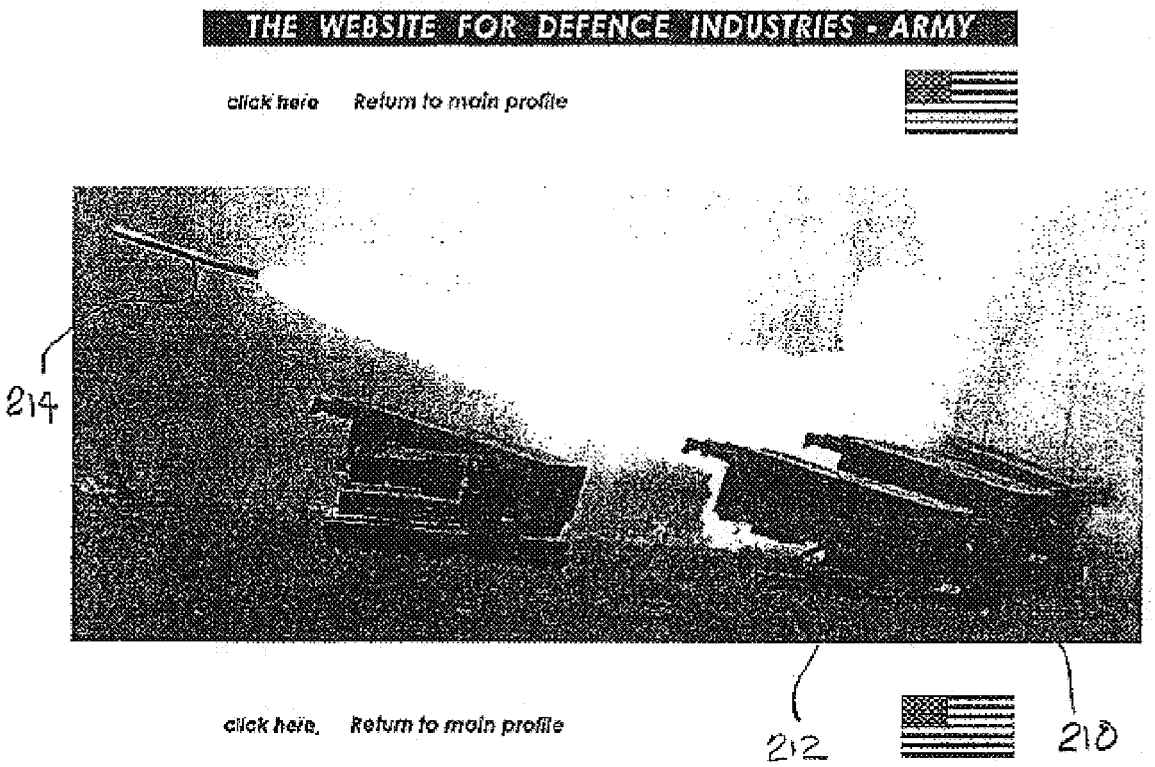
FIG. 19 is a perspective view of a plurality of palletized missile launchers deployed on the ground.

A containerized/palletized mission equipment module requires only relatively short leveling pads (if exact platform level was needed, such as on a radar) or could be set directly on the ground, thus saving weight, volume and the added complexity in cost of deployable outriggers and/or stabilizers as depicted in FIG. 19 where missile launchers 210, transportable on the tilt bed system 10 mounted on a vehicle 12 of the present invention are mounted on short pads 212 are disposed directly on the ground, the missiles 214 being launchable from this disposition. Additionally, containerized/palletized mission equipment eliminates the need for dedicated trailers 200 and/or trucks 206 when the tilt bed system 10 mounted on a vehicle 12 of the present invention is employed to transport such equipment.

Figure 20:
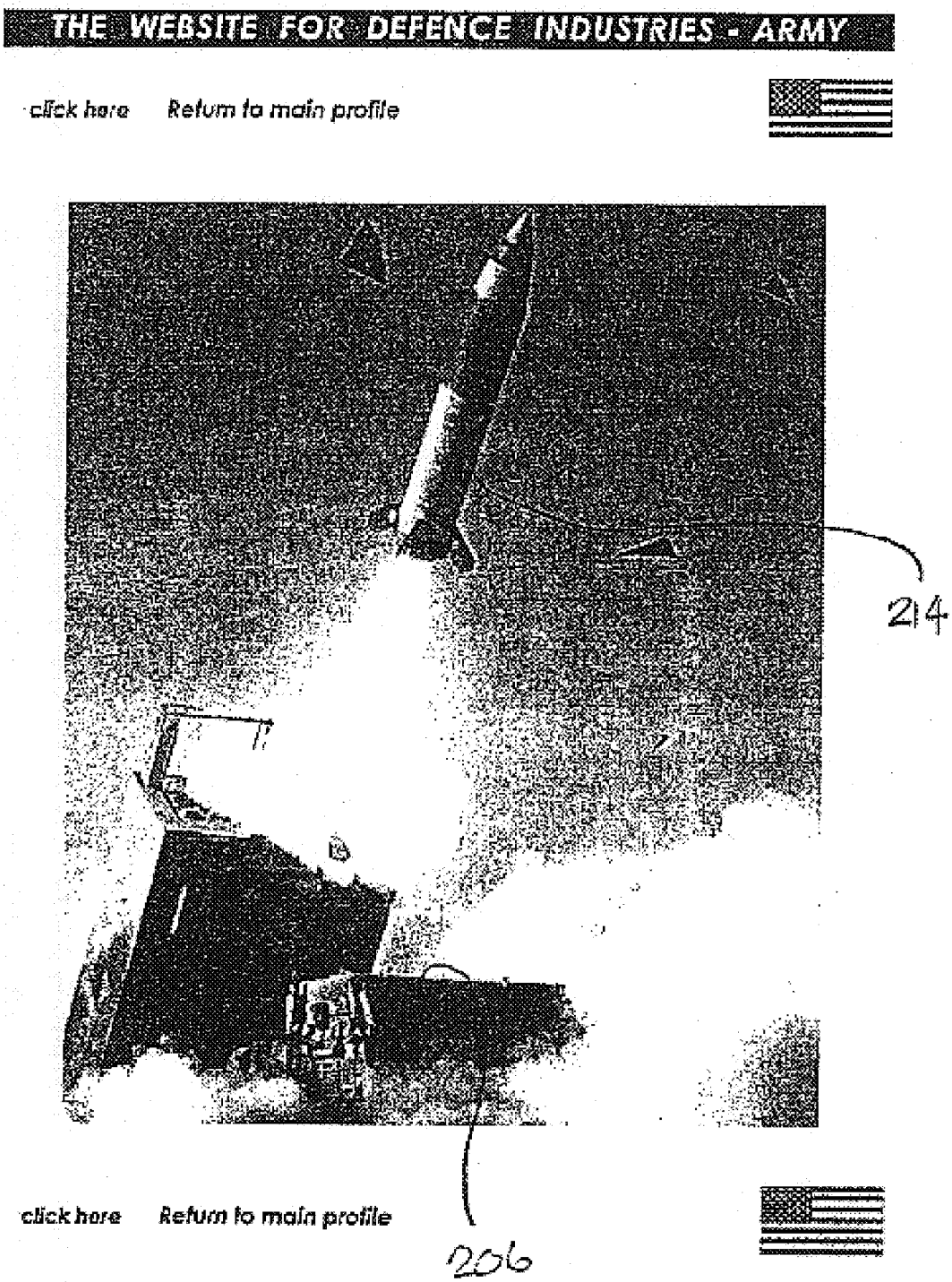
FIG. 20 PRIOR ART
FIG. 20 is a perspective view of a missile launcher mounted on a prior art dedicated truck with missile in launch.
Figure 21:
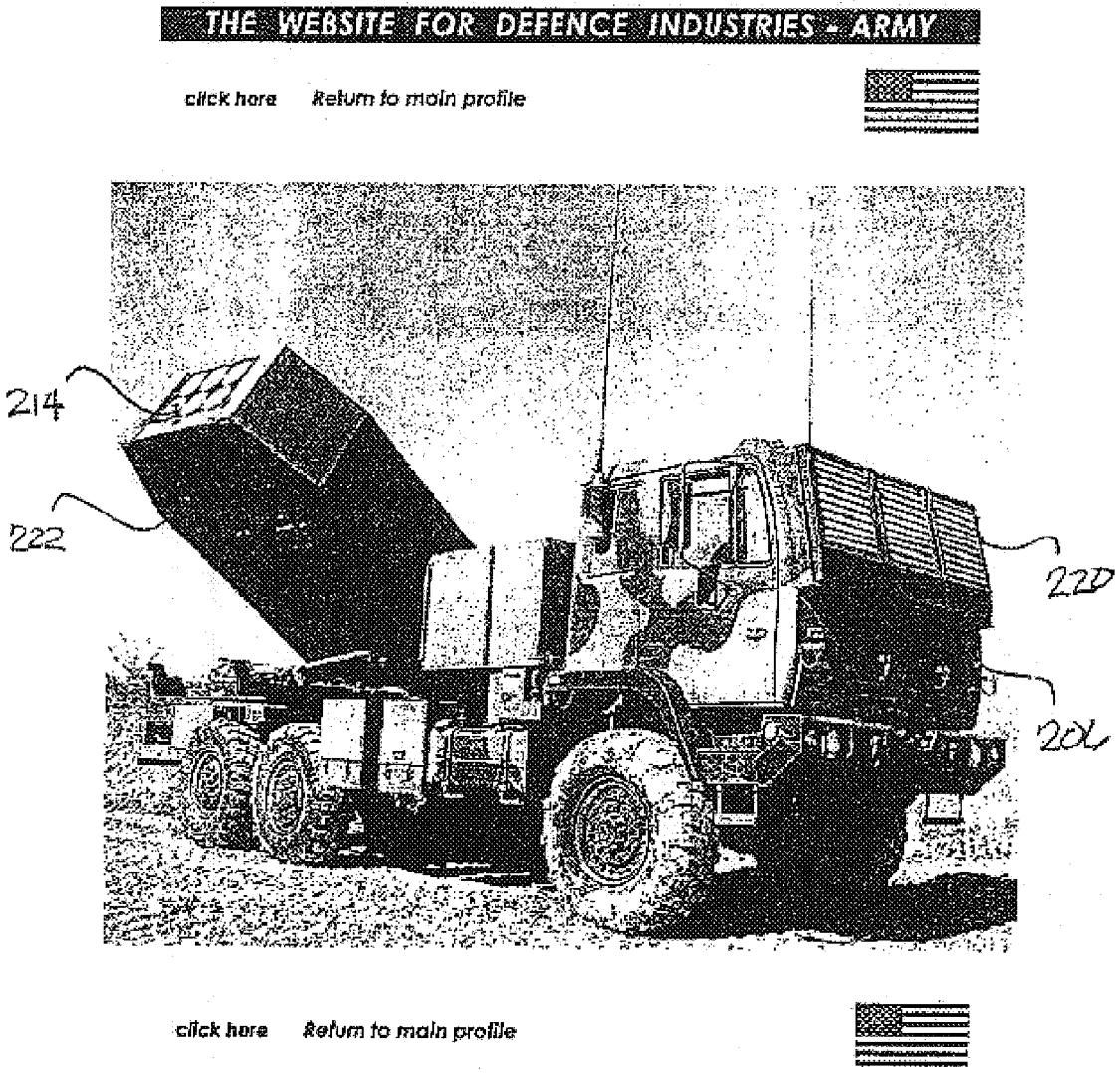
FIG 21 PRIOR ART
FIG. 21 is a perspective view of a missile launcher mounted on a prior art dedicated truck of FIG. 20.

By the launch of the missiles 214 being spatially displaced from the vehicle 12 of the present invention, the shock and heat of the missile launch is not borne by the vehicle 12. Note in the depiction of prior art FIGS. 20 and 21 the impact of the launch of the missile 214 on the dedicated truck 206 and the specialized equipment 220 needed to protect the truck 206. By offloading the container 222 and then removing the tilt bed system 10 mounted on a vehicle 12 of the present invention from the immediate launch site, no such specialized equipment 220 or shock hardening of the vehicle 12 is needed. Advantageously, the same tilt bed system 10 mounted on a vehicle 12 of the present invention that transports a mobile kitchen is capable, without modification, of transporting the missile container 222 to a launch site, where the container 222 is offloaded and the missiles 214 are launched with the container 222 and its base disposed on the ground.

Figure 22:
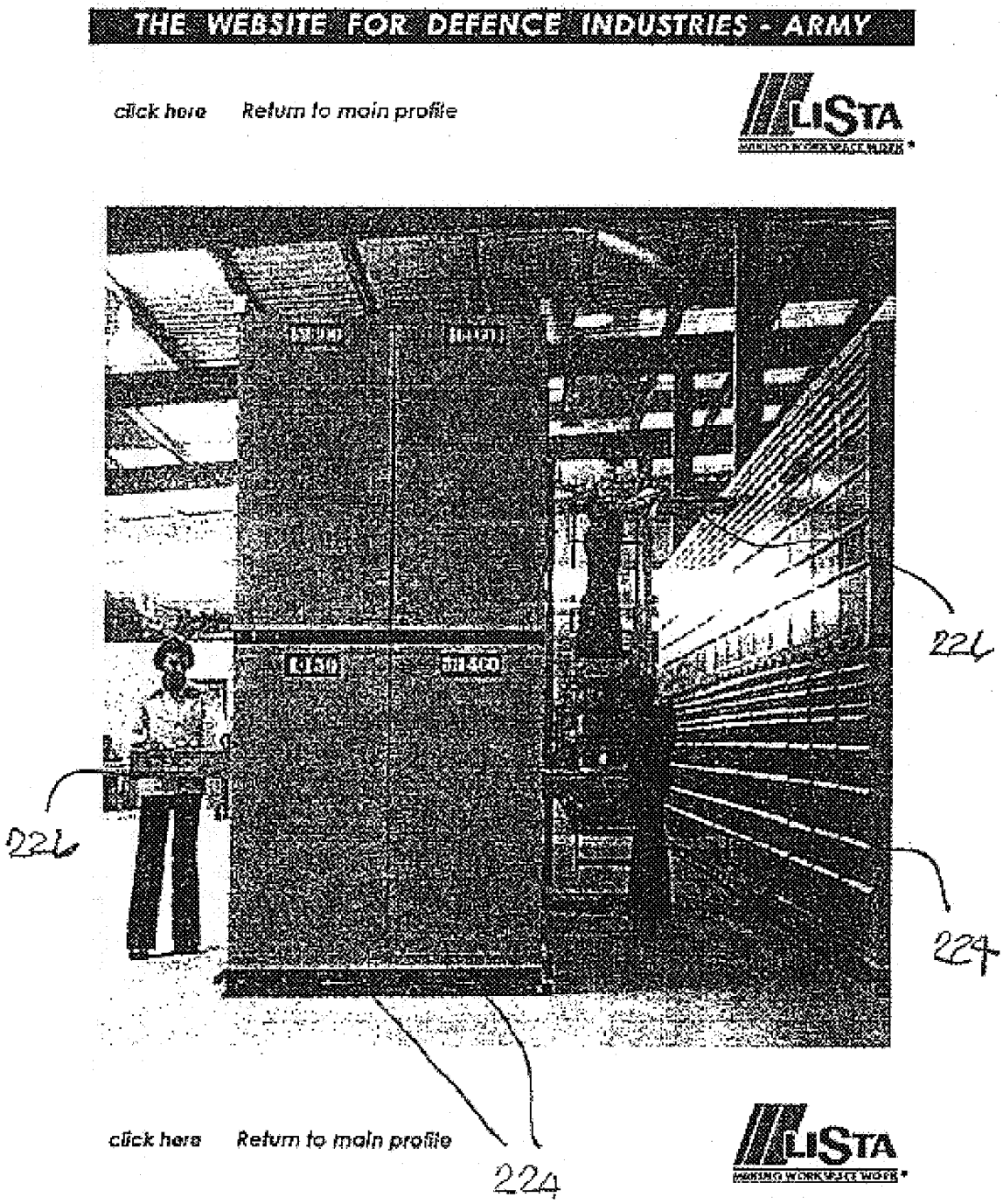
FIG. 22 is a perspective view of a palletized container.

Further, a mission maintenance and repair equipment module 224 (see FIG. 22) when stacked singly and deployed in the field on the ground provides direct ground level access to door and maintenance panels 226, thus eliminating the need for collapsible stairs/steps. As presently configured on an elevated platform, the collapsible stairs/steps need to be stowed when moving (whether on a trailer or the top of a truck). Doing away with the collapsible stairs/steps eliminates weight, cost, and lost volume, while at the same time adds significantly to the safety of operators who may enter at ground level and provides for both ease of maintenance and operation.

Moreover, when the mission equipment module 224 is off loaded and in operation, the tilt bed system 10 mounted on a vehicle 12 of the present invention is available for other tasks such as transporting troops, supplies, and providing basic unit transportation needs without having the need to provide additional vehicles. This is inherently the case since the tilt bed system 10 mounted on a vehicle 12 of the present invention is not dedicated to a particular module 224, but may be used for a variety of tasks. For units that are presumably readily deployable in strength, this advantage greatly reduces the transport required to put the unit in the field ready to operate.

Containerization/palletization of mission equipment 222, 224 that is normally mounted on a dedicated trailer may be transported uploaded on tilt bed system 10 mounted on a vehicle 12 of the present invention when such mission equipment 222, 224 is containerized and palletized. The advantage of such loading is that it improves mobility, maneuverability, and operational flexibility. It reduces deck space requirements on transport ships, thereby allowing more systems to be carried on the same sea-lift assets. The loading of the palletized mission equipment 222, 224 on the tilt bed equipped truck 10 permits the transport of critical mission equipment without having to provide dedicated transport for a trailer on which such equipment is permanently mounted and the accompanying prime mover/carrier. This is true for either initial emergency capability transport or for return/repair. Additionally, not being dedicated, any tilt bed system 10 mounted on a vehicle 12 of the present invention can provide the transport for any given palletized mission equipment module 222, 224.

A further advantage of the tilt bed system 10 mounted on a vehicle 12 of the present invention is for providing enhanced organic cargo handling capability to military units. The tilt bed system 10 mounted on a vehicle 12 has the ability to load and unload palletized and other outsized cargo directly. Prior to the tilt bed 10, a military unit desiring to load and unload palletized and other outsized cargo would normally require the use of a forklift or other material handling equipment to effect such loading and unloading. Use of the tilt bed system 10 mounted on a vehicle 12 eliminates the need for forklifts, etc., in these units. This avoids the problem of having to despatch two vehicles (a transporting vehicle and a load/unload vehicle) to pick up/deliver a load. A frequent problem currently encountered is not having the forklift/material handling equipment in the right place to effect load/unload in a timely manner.

Further, some unit equipment now hand loaded on unit vehicles can be reconfigured to exploit the use of generic or special purpose pallets/containers that may be readily handled with the capabilities of the tilt bed truck 10. Currently, some standard cargo trucks in such units are equipped with a material-handling crane, but the crane is both limited in capacity and reach. The tilt bed system 10 mounted on a vehicle 12 can load and unload much larger loads than the material handling crane currently employed.

Examples of existing palletized/outsized cargo suitable for transport on the tilt bed system 10 mounted on a vehicle 12 of the present invention includes artillery weapons, artillery ammunition, MLRS rocket pods, patriot missile canisters, fuel blivets and maintenance items such as containerized power packs, etc. Examples of unit equipment not currently palletized but which would lend itself to palletization or transport on the tilt bed system 10 mounted on a vehicle 12 of the present invention includes individual crew gear, ruck-sacks, duffle bags, unit tools/tool boxes, communication equipment, mess and other specialized gear equipment.

The tilt bed system 10 of the present invention is also useful for minimizing the need for specialized material/cargo trucks that are organic to the military units. Such specialized material/cargo trucks are presently needed to handle large palletized loads. The tilt bed system 10 is configurable to handle such palletized loads while at the same time preserving the ability to haul both troops and general cargo. The latter is something that presently utilized specialized materials/cargo trucks cannot now do without an empty Flat Rack being available.

Additionally, the tilt bed system 10 mounted on a vehicle 12 provides a recovery vehicle capable of allowing the unit to recover a disabled vehicle such as a HUMV by uploading it on the tilt bed system 10 without the use of a specialized recovery vehicle (wrecker) and/or without having to have specialized tow bars/cables to tow a disabled vehicle. This capability makes every tilt bed system 10 mounted on a vehicle 12 in the unit a potential recovery vehicle and maximizes the unit's flexibility to deal with recovery problems. Such usage provides the unit with the benefits of superior control, mobility, and the potential for a faster, safer recovery. Further, it minimizes the loss of time and increases overall unit responsiveness.

Figure 23:
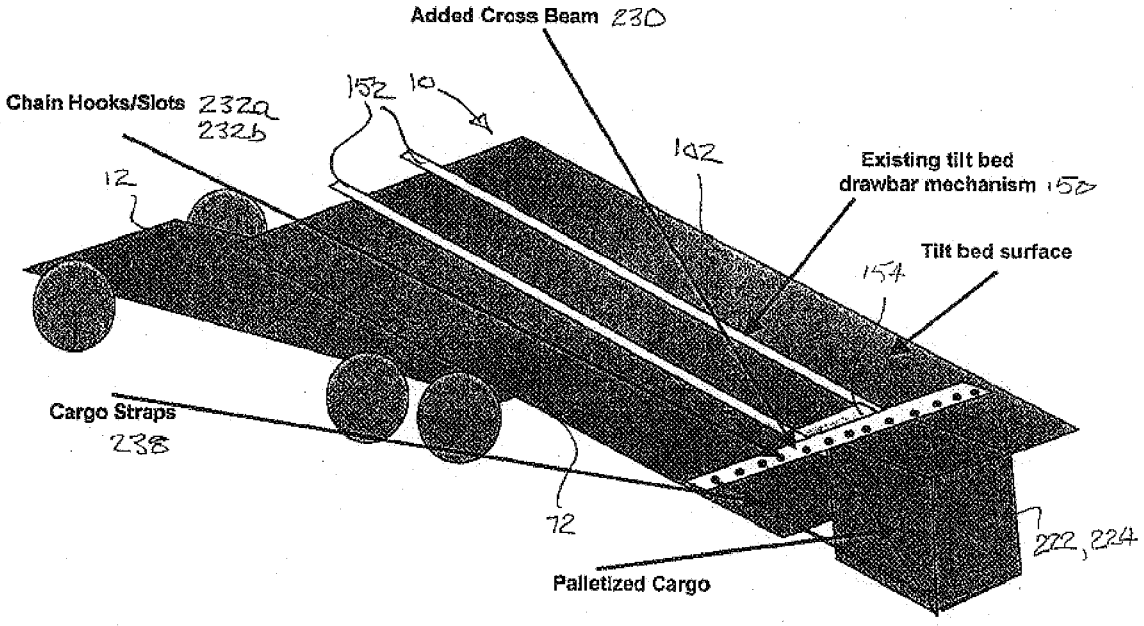
FIG. 23 is a perspective schematic representation of the improved tilt bed system mounted on a vehicle of the present invention with palletized cargo in position for loading.
Figure 24:
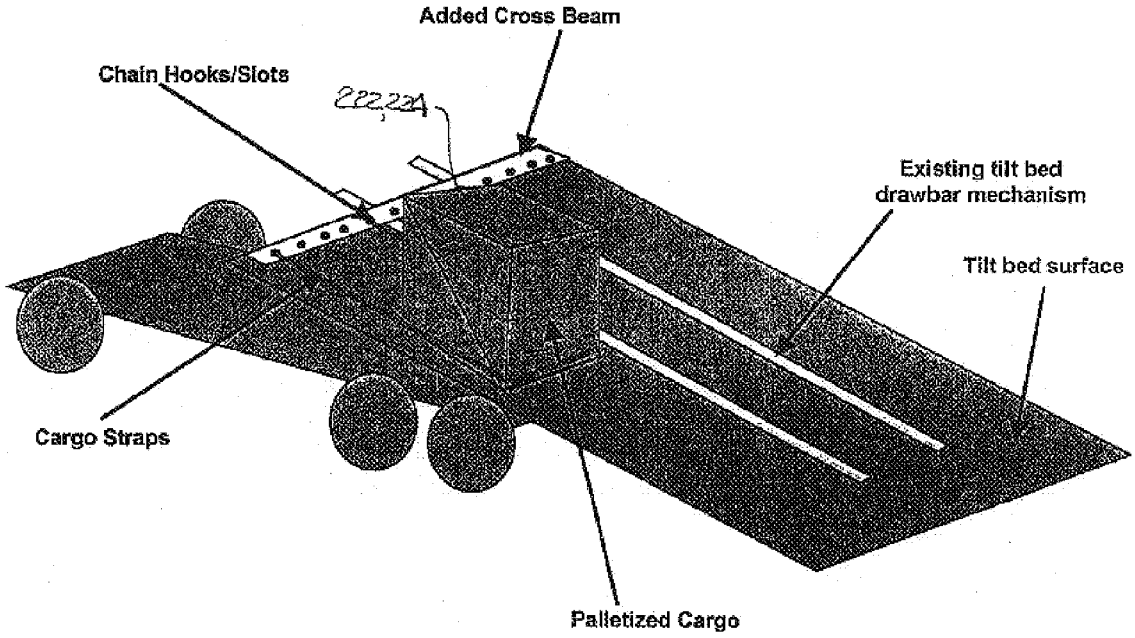
FIG. 24 is a perspective schematic representation of the improved tilt bed system mounted on a vehicle of the present invention with palletized cargo in the loaded position.
Figure 25:
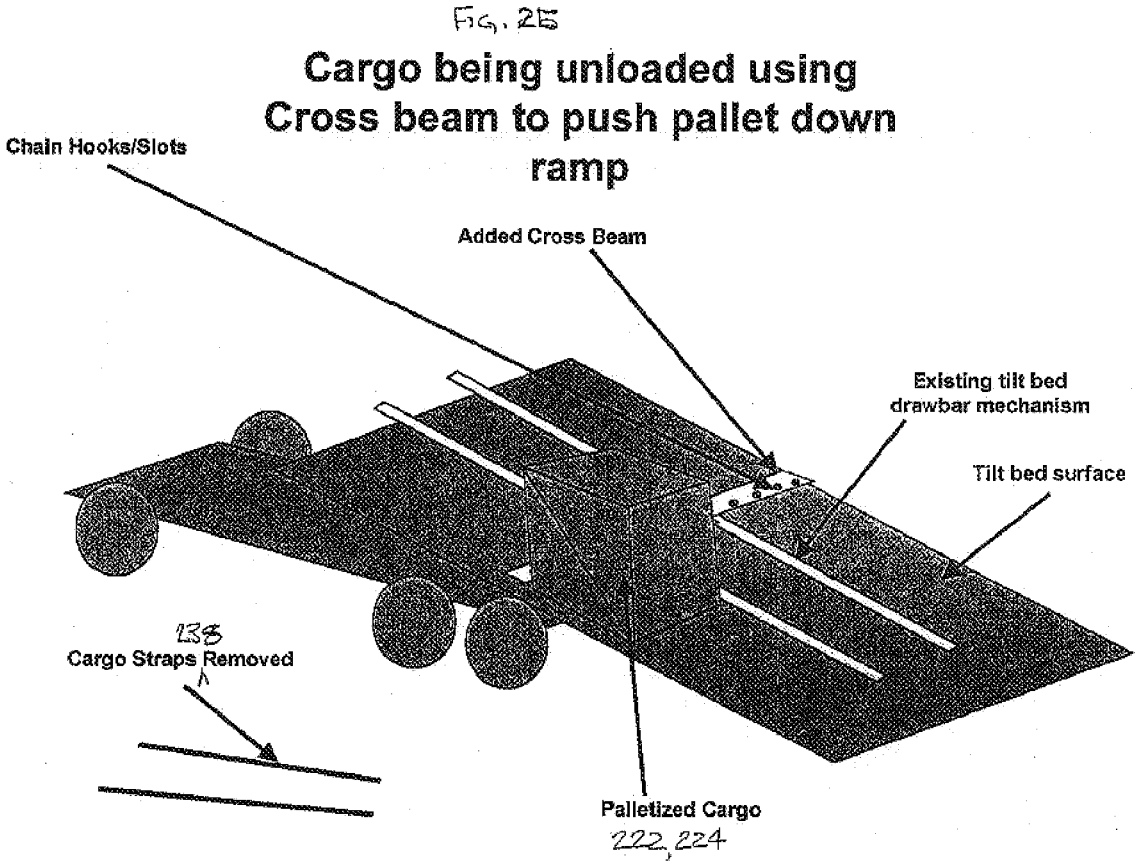
FIG. 25 is a perspective schematic representation of the improved tilt bed system mounted on a vehicle of the present invention with palletized cargo in position for unloading.

Loading operations, utilizing the enhanced organic cargo handling system of the present invention, for any given palletized mission equipment module 222, 224 are depicted in FIGS. 23–25. FIG. 23 depicts a palletized mission equipment module 222, 224 just starting to move up the tilt bed assembly 102. Prior to commencing such motion, the cylinder 116 (see FIG. 6*a*) is extended to tilt the tilt bed 72 relative to the frame 26 of the vehicle 12. The tilt bed 72 is tilted a sufficient amount such that the lower margin 142 of the tow pintle 140 is in contact with the surface upon which the vehicle 12 is resting. The tilt bed assembly 102 is translated rearward relative to the tilt frame assembly 100 until the rear margin of the tilt bed assembly 102 is also in contact with the surface. The guide device 154 is translated rearward in the track 152 of the powered guide system 150.

A removable cross beam 230 is affixed to the guide device. The cross beam 230 may be stored for transport when not in use on the vehicle 12 in an undersung, transverse rack 234 or a longitudinal rack 236, as depicted in FIG. 1. The cross beam 230 has a plurality of chain hooks 232 and/or slots 232*b* emplaced along the span of the cross beam 230 to facilitate readily engaging any given palletized mission equipment module 222, 224 for transport by means of cargo straps 238. The cargo straps 238 could be extended around the palletized mission equipment module 222, 224, as depicted, or could be coupled to the front of the palletized mission equipment module 222, 224. A cargo strap 238 with loop ends is engageable with hooks 232*a*. A cargo strap 238 with hooks is engageable with the slots 232*b*. The slots 232*b* may simply be holes sized for a pin or clevis or shaped like a "T" for securing a chain. Alternatively, fastening means may include any combination of hook, ring or aperture for engaging and securing a payload. The drawbar mechanism 150 is then retracted up the track 152, drawing with it the palletized mission equipment module 222, 224.

Unloading of the palletized mission equipment module 222, 224 is as depicted in FIG. 26. The cargo straps 238 are removed. The cross beam 230 affixed to the guide device 154. The guide device 154 is translated rearward in the track 152 of the powered guide system 150. The cross beam 230 engages the leading edge of the palletized mission equipment module 222, 224 and, assisted by gravity, pushes the palletized mission equipment module 222, 224 downward onto the ground.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A bed disposable on a tactical vehicle for providing an organic cargo handling system, comprising:

a tiltable bed portion, the tiltable bed portion including a quick hitch, the tiltable bed portion quick hitch being translatably disposed on a track, the track being operably coupled to the tiltable bed portion, the quick hitch being powerable in a first direction along the track and being powerable in a second opposed direction alone the track; and a cargo handling apparatus being couplable to the quick hitch for selective engagement with an article to be transported on the tactical vehicle, the cargo handling apparatus for advancing said article up the tiltable bed portion for loading thereon and for urging the article down the tiltable bed portion for off loading therefrom, the cargo handling apparatus including a cross bar disposable substantially transverse relative to a tiltable bed portion centerline, the cross bar having a plurality of hooks disposed spanwise along the cross bar, the hooks for being engaged by cargo handling straps.

2. The bed of claim 1 wherein the tiltable bed portion includes a powered cable winch operably coupled thereto for drawing the article to a disposition proximate a tiltable bed portion rear margin.

3. The bed of claim 2 wherein the tiltable bed portion includes a gravity operated conveyor disposable on the tiltable bed portion, the conveyor for facilitating the transfer of articles down the tiltable bed portion when the tiltable bed portion is in a substantially horizontal, transport disposition.

4. The bed of claim 3 wherein the gravity operated conveyor is disposable in part on a stationary bed portion for effecting the transfer of objects stored on the stationary bed portion directly to a ground surface.

5. The bed of claim 1 including a stationary bed portion, the stationary bed portion presenting an upward directed cargo surface.

6. The bed of claim 1 including a receptacle for receiving and temporarily storing the cross bar therein.

7. The bed of claim 1 wherein the article or combination of articles, subject to weight and size constraints, are selected from a list consisting of; artillery pieces, artillery ammunition, MLRS rocket pods, patriot missile canisters, fuel blivets and maintenance items, containerized power packs, a disabled vehicle, and palletized items including individual crew gear, ruck-sacks, duffle bags, unit tools/tool boxes, communication equipment, radar equipment, command and control modules, mess and other specialized gear equipment.

8. A bed disposable on a tactical vehicle for providing an organic cargo handling system, comprising:

a tiltable bed portion, the tiltable bed portion including a quick hitch, the tiltable bed portion quick hitch being translatably disposed on a track, the track being operably coupled to the tiltable bed portion, the quick hitch being powerable in a first direction alone the track and being powerable in a second opposed direction along the track; and a cargo handling apparatus being couplable to the quick hitch for selective engagement with an article to be transported on the tactical vehicle, the cargo handling apparatus for advancing said article up the tiltable bed portion for loading thereon and for urging the article down the tiltable bed portion for offloading therefrom, the cargo handling apparatus including a cross bar disposable substantially transverse relative to a tiltable bed portion centerline, the cross bar having a plurality of apertures disposed spanwise along the cross bar, each aperture adapted to be engaged by a hook of a cargo handling strap.

9. The bed of claim 8 wherein the tiltable bed portion includes a powered cable winch operably coupled thereto for drawing the article to a disposition proximate a tiltable bed portion rear margin.

10. The bed of claim 9 wherein the tiltable bed portion includes a gravity operated conveyor disposable on the tiltable bed portion, the conveyor for facilitating the transfer of articles down the tiltable bed portion when the tiltable bed portion is in a substantially horizontal, transport disposition.

11. The bed of claim 10 wherein the gravity operated conveyor is disposable in part on a stationary bed portion for effecting the transfer of objects stored on the stationary bed portion directly to a around surface.

12. The bed of claim 8 including a stationary bed portion, the stationary bed portion presenting an upward directed cargo surface.

13. The bed of claim 8 including a receptacle for receiving and temporarily storing the cross bar therein.

14. The bed of claim 8 wherein the article or combination of articles, subject to weight and size constraints, are selected from a list consisting of; artillery pieces, artillery ammunition, MLRS rocket pods, patriot missile canisters, fuel blivets and maintenance items, containerized power packs, a disabled vehicle, and palletized items including individual crew ear ruck-sacks duffle bags, unit tools/tool boxes communication equipment, radar equipment command and control modules, mess and other specialized sear equipment.

15. A bed disposable on a tactical vehicle for providing an organic cargo handling system, comprising:

a tiltable bed portion, the tiltable bed portion being tiltable between a substantially horizontal cargo bearing transport disposition and a tilted disposition for the loading and unloading of cargo therefrom; a tiltable bed portion rear margin disposable proximate a around surface when the tiltable bed portion is in the tilted disposition; and a cargo handling apparatus being powered and shiftable along the tiltable bed portion track when the tiltable bed portion is in the tilted disposition and having cargo engagement means for selective engagement with an article to be transported on the tactical vehicle to advance said article up the tiltable bed portion for loading thereon and to urge the article down the tiltable bed portion for offloading thereof, the cargo handling apparatus including a cross bar being disposable substantially transverse relative to a tiltable bed portion centerline, the cross bar having a plurality of hooks disposed spanwise along the cross bar, the hooks for being engageable by loops of cargo handling straps.

16. The bed system of claim 15 wherein the tiltable bed portion includes a powered cable winch operably coupled thereto for drawing the article to a disposition proximate the tiltable bed portion rear margin.

17. The bed of claim 16 wherein the tiltable bed portion includes a gravity operated conveyor disposable on the tiltable bed portion, the conveyor for facilitating the transfer of articles down the tiltable bed portion when the tiltable bed portion is in the transport disposition.

18. The bed of claim 17 wherein the gravity operated conveyor is disposable in part on a stationary bed portion for effecting the transfer of objects stored on the stationary bed portion directly to a ground surface.

19. The bed of claim 15 including a stationary bed portion, the stationary bed portion presenting an upward directed cargo surface.

20. The bed of claim 15 the bed including a storage receptacle for receiving and temporarily storing the cross bar therein.

21. The bed of claim 15 wherein the article or combination of articles, subject to weight and size constraints of the bed, are selected from a list consisting of: artillery pieces, artillery ammunition, MLRS rocket pods, patriot missile canisters, fuel blivets and maintenance items, containerized power packs, a disabled vehicle, and palletized items including individual crew gear, ruck-sacks, duffle bags, unit tools/tool boxes, communication equipment, radar equipment, command and control modules, mess and other specialized gear equipment.

22. A bed disposable on a tactical vehicle for providing an organic cargo handling system, comprising:

a tiltable bed portion, the tiltable bed portion being tiltable between a substantially horizontal cargo bearing transport disposition and a tilted disposition for the loading and unloading of cargo therefrom a tiltable bed portion rear margin disposable proximate a around surface when the tiltable bed portion is in the titled disposition; and a cargo handling apparatus being powered and shiftable alone the tiltable bed portion track when the tiltable bed portion is in the tilted disposition and having cargo engagement means for selective engagement with an article to be transported on the tactical vehicle to advance said article up the tiltable bed portion for loading thereon and to urge the article down the tiltable bed portion for offloading thereof, the cargo handling apparatus including a cross bar being disposable substantially transverse relative to a tiltable bed portion centerline, the cross bar having a plurality of apertures disposed spanwise along the cross bar, the apertures for being engaged by hooks of cargo handling straps.

23. The bed system of claim 22 wherein the tillable bed portion includes a powered cable winch operably coupled thereto for drawing the article to a disposition proximate the tiltable bed portion rear margin.

24. The bed of claim 23 wherein the tillable bed portion includes a gravity operated conveyor disposable on the tillable bed portion, the conveyor for facilitating the transfer of articles down the tiltable bed portion when the tiltable bed portion is in the transport disposition.

25. The bed of claim 24 wherein the gravity operated conveyor is disposable in part on the stationary bed portion for effecting the transfer of objects stored on the stationary bed portion directly to a around surface.

26. The bed of claim 22 including a stationary bed portion, the stationary bed portion presenting an upward directed cargo surface.

27. The bed of claim the bed including a storage receptacle for receiving and temporarily storing the cross bar therein.

28. The bed of claim 22 wherein the article or combination of articles, subject to weight and size constraints of the bed, are selected from a list consisting of: artillery pieces, artillery ammunition, MLRS rocket pods, patriot missile canisters, fuel blivets and maintenance items, containerized power sacks, a disabled vehicle, and palletized items including individual crew near, ruck-sacks, duffle bags, unit tools/tool boxes, communication equipment, radar equipment, command and control modules, mess and other specialized gear equipment.

29. A method of deploying material in a field comprising:

tilting a tiltable vehicle bed to a tilted load/unload disposition from a substantially horizontal transport disposition to receive the material;

removably disposing a cross bar substantially transverse relative to a tiltable bed portion centerline;

disposing a plurality of books spanwise along the cross bar, the hooks for being engageable by loops of cargo handling straps;

drawing the material up the tiltable vehicle bed with a powered, tracked cargo handling device;

tilting the tiltable vehicle bed to the substantially horizontal transport disposition;

transporting the material to an unload site;

tilting a tiltable vehicle bed to the tilted load/unload disposition to discharge the material; and pushing of the material down the tiltable vehicle bed with the powered, tracked cargo handling device.

30. The method of claim 29 including drawing the material to a disposition proximate a tiltable bed portion rear margin by means of a powered cable winch.

31. The method of claim 30 including facilitating the transfer of material down the tiltable bed portion when the tiltable bed portion is in the transport disposition by means of a gravity operated conveyor.

32. The method of claim 31 including disposing the gravity operated conveyor in part on a stationary bed portion for effecting the transfer of material stored on the stationary bed portion directly to a ground surface.

33. The method of claim 29 including providing a stationary bed portion, the stationary bed portion presenting an upward directed cargo surface.

34. The method of claim 29 including receiving and temporarily storing the cross bar in a receptacle disposed proximate the vehicle bed.

35. The method of claim 29 including selecting the article or combination of articles, subject to weight and size constraints of the bed, from a list consisting of: artillery pieces, artillery ammunition, MLRS rocket pods, patriot missile canisters, fuel blivets and maintenance items, containerized power packs, a disabled vehicle, and palletized items including individual crew gear, ruck-sacks, duffle bags, unit tools/tool boxes, communication equipment, radar equipment, command and control modules, mess and other specialized gear equipment.

36. A method of deploying material in a field comprising:

tilting a tiltable vehicle bed to a tilted load/unload disposition from a substantially horizontal transport disposition to receive the material;

removably disposing a cross bar substantially transverse relative to a tillable bed portion centerline;

disposing a plurality of apertures spanwise along the cross bar, the apertures for being engageable by hooks of cargo handling straps;

drawing the material up the tiltable vehicle bed with a powered, tracked cargo handling device;

tilting the tiltable vehicle bed to the substantially horizontal transport disposition;

transporting the material to an unload site;

tilting a tiltable vehicle bed to the tilted load/unload disposition to discharge the material; and pushing of the material down the tiltable vehicle bed with the powered, tracked cargo handling device.

37. The method of claim 26 including drawing the material to a disposition proximate a tiltable bed portion rear margin by means of a powered cable winch.

38. The method of claim 37 including facilitating the transfer of material down the tiltable bed portion when the tiltable bed portion is in the transport disposition by means of a gravity operated conveyor.

39. The method of claim 38 including disposing the gravity operated conveyor in part on a stationary bed portion for effecting the transfer of material stored on the stationary bed portion directly to a ground surface.

40. The method of claim 36 including providing a stationary bed portion, the stationary bed portion presenting an upward directed cargo surface.

41. The method of claim 36 including receiving and temporarily storing the crass bar in a receptacle disposed proximate the vehicle bed.

42. The method of claim 36 including selecting the article or combination of articles, subject to weight and size constraints of the bed, from a list consisting of: artillery nieces, artillery ammunition, MLRS rocket pods, patriot missile canisters, fuel blivets and maintenance items, containerized power packs, a disabled vehicle, and palletized items including individual crew gear, ruck-sacks, duffle bags, unit tools/tool boxes, communication equipment, radar equipment, command and control modules, mess and other specialized gear equipment.

* * * * *

UNITED STATES PATENT AND TRADEMARK OFFICE

CERTIFICATE OF CORRECTION

PATENT NO. : 6,748,845 B2
DATED : June 15, 2004
INVENTOR(S) : Staiert et al.

It is certified that error appears in the above-identified patent and that said Letters Patent is hereby corrected as shown below:

Column 1,
Line 35, after need, delete "is".

Column 8,
Line 46, delete "moments" and insert -- movements --.

Column 12,
Line 12, delete "undersung" and insert -- underslung --.
Line 52, delete "alone" and insert -- along --.
Line 59, delete "off loading" and insert -- offloading --.

Column 13,
Line 33, delete "alone" and insert -- along --.
Line 60, delete "around" and insert -- ground --.

Column 14,
Line 5, delete "ear" and insert -- gear --.
Line 6, after "equipment" insert -- , --.
Line 7, delete "sear" and insert -- gear --.
Lines 15 and 66, delete "around" and insert -- ground --.
Line 47, after "15" insert -- , --.
Line 65, after "therefrom" insert -- , --.

Column 15,
Line 2, delete "alone" and insert -- along --.
Lines 14, 18 and 20, delete "tillable" and insert -- tiltable --.
Line 26, delete "around" and insert -- ground --.
Line 30, after "claim" insert -- 37 --.
Line 38, delete "sacks" and insert -- packs --.
Line 39, delete "near" and insert -- gear --.
Line 50, delete "books" and insert -- hooks --.
Line 60, indent before the word "pushing".

UNITED STATES PATENT AND TRADEMARK OFFICE

CERTIFICATE OF CORRECTION

PATENT NO. : 6,748,845 B2
DATED : June 15, 2004
INVENTOR(S) : Staiert et al.

It is certified that error appears in the above-identified patent and that said Letters Patent is hereby corrected as shown below:

Column 16,
Line 26, delete "tillable" and insert -- tiltable --.
Line 39, delete "26" and insert -- 47 --.
Line 54, delete "crass" and insert -- cross --.
Line 58, delete "nieces" and insert -- pieces --.

Signed and Sealed this

Nineteenth Day of July, 2005

JON W. DUDAS
*Director of the United States Patent and Trademark Office*